US009248952B2

(12) United States Patent
Burrous et al.

(10) Patent No.: US 9,248,952 B2
(45) Date of Patent: Feb. 2, 2016

(54) DISPENSER FOR CONDUIT, RELATED COMPONENTS, AND TOOLS

(71) Applicant: Rain Bird Corporation, Azusa, CA (US)

(72) Inventors: Robert A. Burrous, Tucson, AZ (US); Clint R. Haas, Tucson, AZ (US); James A. Elzey, Tucson, AZ (US)

(73) Assignee: Rain Bird Corporation, Azusa, CA (US)

( * ) Notice: Subject to any disclaimer, the term of this patent is extended or adjusted under 35 U.S.C. 154(b) by 0 days.

(21) Appl. No.: 13/800,954

(22) Filed: Mar. 13, 2013

(65) Prior Publication Data

US 2014/0262866 A1 Sep. 18, 2014

(51) Int. Cl.

| | |
|---|---|
| ***B65D 85/04*** | (2006.01) |
| ***B25H 3/00*** | (2006.01) |
| ***B25H 3/02*** | (2006.01) |

(52) U.S. Cl.

CPC ..... *B65D 85/04* (2013.01); *B25H 3/006* (2013.01); *B25H 3/021* (2013.01)

(58) Field of Classification Search

CPC ..... B65D 85/04; B65D 85/67; B25H 3/006; B25H 3/021; B65H 75/362; B65H 75/00

USPC ..... 206/409, 408, 389, 225, 373; 242/587, 242/588.3, 170

See application file for complete search history.

(56) References Cited

U.S. PATENT DOCUMENTS

| | | | | |
|---|---|---|---|---|
| 1,937,468 | A | | 11/1933 | Talbot |
| 2,871,057 | A | | 1/1959 | Bernyk |
| 3,096,951 | A | | 7/1963 | Ernest |
| 3,700,185 | A | | 10/1972 | Hubbard |
| 3,822,784 | A | | 7/1974 | Thompson et al. |
| 3,823,894 | A | | 7/1974 | Frederick |
| 3,983,997 | A | | 10/1976 | Warshaw |
| 4,451,014 | A | | 5/1984 | Kitt et al. |
| 4,460,086 | A | | 7/1984 | Davis |
| 4,591,110 | A | | 5/1986 | Wirts et al. |
| 4,705,657 | A | | 11/1987 | Poulin |
| 4,984,685 | A | * | 1/1991 | Douglas ..... 206/702 |
| 5,103,977 | A | * | 4/1992 | Douglas ..... 206/702 |
| 5,337,892 | A | * | 8/1994 | Zaffina ..... 206/315.11 |
| 5,392,901 | A | * | 2/1995 | Kuray et al. ..... 206/3 |
| 5,403,277 | A | | 4/1995 | Dodge et al. |
| 5,421,457 | A | | 6/1995 | Listenberger |

(Continued)

FOREIGN PATENT DOCUMENTS

JP H05-170273 A 7/1993

OTHER PUBLICATIONS http://www.pacificcable.com/Picture_Page.asp?DataName=BP0033-PTZ1000, 2 pages, accessed Jan. 19, 2011.

(Continued)

*Primary Examiner* — Steven A. Reynolds

(74) *Attorney, Agent, or Firm* — Fitch Even Tabin & Flannery, LLP

(57) ABSTRACT

A dispenser for conduit and related components and tools is provided. In one form, the dispenser includes a first container configured to receive tubing and a second container configured to be connected to the first container. The second container has one or more compartments for containing one or more components or tools for use with the tubing.

18 Claims, 23 Drawing Sheets

(56) References Cited

U.S. PATENT DOCUMENTS

| | | | | |
|---|---|---|---|---|
| 5,441,163 | A * | 8/1995 | Carrasco | 220/23.86 |
| 5,494,160 | A | 2/1996 | Gelmetti | |
| 5,755,057 | A * | 5/1998 | Dancer | 43/54.1 |
| 5,848,701 | A * | 12/1998 | Riccabona | 206/702 |
| 5,915,641 | A | 6/1999 | Barberg | |
| 6,021,974 | A | 2/2000 | Koskelainen | |
| 6,047,842 | A * | 4/2000 | Feidt | 220/23.88 |
| 6,430,760 | B2 | 8/2002 | Johns | |
| 6,460,287 | B1 * | 10/2002 | Louie | 43/54.1 |
| 6,648,164 | B1 * | 11/2003 | DeCola et al. | 220/505 |
| 6,749,139 | B2 | 6/2004 | Speck | |
| 7,293,734 | B1 | 11/2007 | Kantner | |
| 7,497,327 | B2 * | 3/2009 | Martinez et al. | 206/225 |
| 8,205,749 | B2 * | 6/2012 | Korpanty et al. | 206/508 |
| 2004/0035748 | A1 * | 2/2004 | Hernandez et al. | 206/748 |
| 2006/0124505 | A1 * | 6/2006 | Hanson | 206/702 |
| 2007/0029215 | A1 * | 2/2007 | Martinez et al. | 206/223 |
| 2010/0000895 | A1 | 1/2010 | Weissbrod | |
| 2010/0314483 | A1 * | 12/2010 | Shah et al. | 242/587 |
| 2012/0042615 | A1 | 2/2012 | Roche | |

OTHER PUBLICATIONS http://www.licensedelectrician.com/Store/RT/Wire_Tub.htm, 3 pages, accessed Jan. 19, 2011.

http://www.cablestogo.com/product.asp?cat_id=3540 &sku=28428, 1 page, accessed Jan. 19, 2011.

http://www.dripirrigation.com/drip_irrigation_info.php?cPath=36 &products_id=1058&osCsid=tgofusun55domlc514g222sta4, accessed Jan. 19, 2011.

Rain Bird, XQ 1/4 Distribution Tubing brochure, 2 pages. Publicly available at least one year before Mar. 13, 2013.

Maxijet, The 500 Foot Bucket, 1 page. Publicly available at least one year before Mar. 13, 2013.

* cited by examiner

DISPENSER FOR CONDUIT, RELATED COMPONENTS, AND TOOLS

FIELD

The invention relates to conduit and components and tools for use with conduit and, more particularly, to a method and apparatus for storing and dispensing conduit and components and tools for use with conduit.

BACKGROUND

Conduit, such as tubing, is available in numerous materials and sizes. Non-rigid tubing is generally made of a plastic material, such as vinyl or polyethylene. Tubing size is determined based on the inner diameter, which defines the cross section of the cavity within the tubing, and the outer diameter. The difference between the inner and outer diameter defines the tubing thickness.

Tubing generally has a smooth, annular inner surface configured to minimize pressure loss as a fluid passes therethrough. Further, the tubing may have a smooth outer surface for providing a tight seal between the tubing and a connecting member, such as a valve.

Tubing is generally sold in predetermined lengths, such as 50 or 100 feet. In order to conveniently deliver longer lengths, the tubing is generally packaged as a coil or wound around a spool. Coiled tubing includes a central opening with the tubing oriented around the central opening in a helical arrangement. The tubing is coiled around the central opening until the entire length of tubing is positioned around the central opening. Coiled tubing is packaged to maintain the coiled configuration of the tubing, such as with shrink wrap extending around the outer perimeter of the coiled tubing or with straps or bands extending around a section of the tubing. The resultant product is not easy to handle, as the securing packaging is prone being punctured or ripped, which compromises the ability of the securing packaging to maintain the coiled configuration of the tubing. Further, the securing packaging can be damaged by other elements, such as tools, sticks, and other sharp objects. It is also difficult to dispense because once the shrink wrap or bands are first removed the coil is unbound and free to unwind.

Tubing also can be wrapped about a central spool member. The spool includes a generally cylindrical body around which the tubing is wrapped and enlarged end stops to prevent the tubing from coming off the ends of the cylindrical body. The free end of the tubing extends out from the wrapped tubing and away from the spool. To maintain the wrapped configuration, the free end of the tubing can be further secured to the spool. If the free end is not secured after use, the tubing can come unwrapped from the spool.

Further, because the free end extends from the outer edge of the wrapped tubing, in order to remove the tubing from the spool the relative positions thereof must be manipulated. In other words, to remove the tubing from the spool, the spool must be rotated relative to the free end of the tubing. Alternatively, the free end of the tubing can be shifted around the spool in a direction opposite the wrapping direction. As a result, tubing can be difficult to remove from a spool, particularly where the work space is limited.

In addition, the packaging for the coiled tubing and the spool wrapped tubing is generally not reusable due to the costs and effort associated with reusing the packaging. As a result, the packaging used is configured to be cost effective and not for repeated field use. In particular, packaging usually includes shrink wrap, which is prone to punctures and tearing, and cardboard, which has little to no functionality after being exposed to water. As a result, the existing packaging for transporting and dispensing tubing are not well suited for field use, particularly when all the tubing in a given package is not utilized in a single use or in the presence of water, tools or other sharp objects.

Another problem with existing packaged tubing is that maintenance of irrigation systems, such as drip irrigation systems, is not always a one-time event. For example, a homeowner may need to repair or expand an installed drip irrigation system over time. This type of maintenance is inconvenient because small system components, tools, and tubing are stored in a garage, but most of the work is performed at various places throughout the yard. The homeowner may resort to several trips back and forth between the garage and the yard in order to complete the repair or expansion.

Yet another shortcoming of some existing packaged irrigation system components is that the components are often sold from cardboard displays in stores. Cardboard displays may be expensive to design, manufacture, and install. Further, cardboard displays are often not suitable for outdoor use because the displays may become wet and fall apart.

DETAILED DESCRIPTION OF THE DRAWINGS

Figure 1:
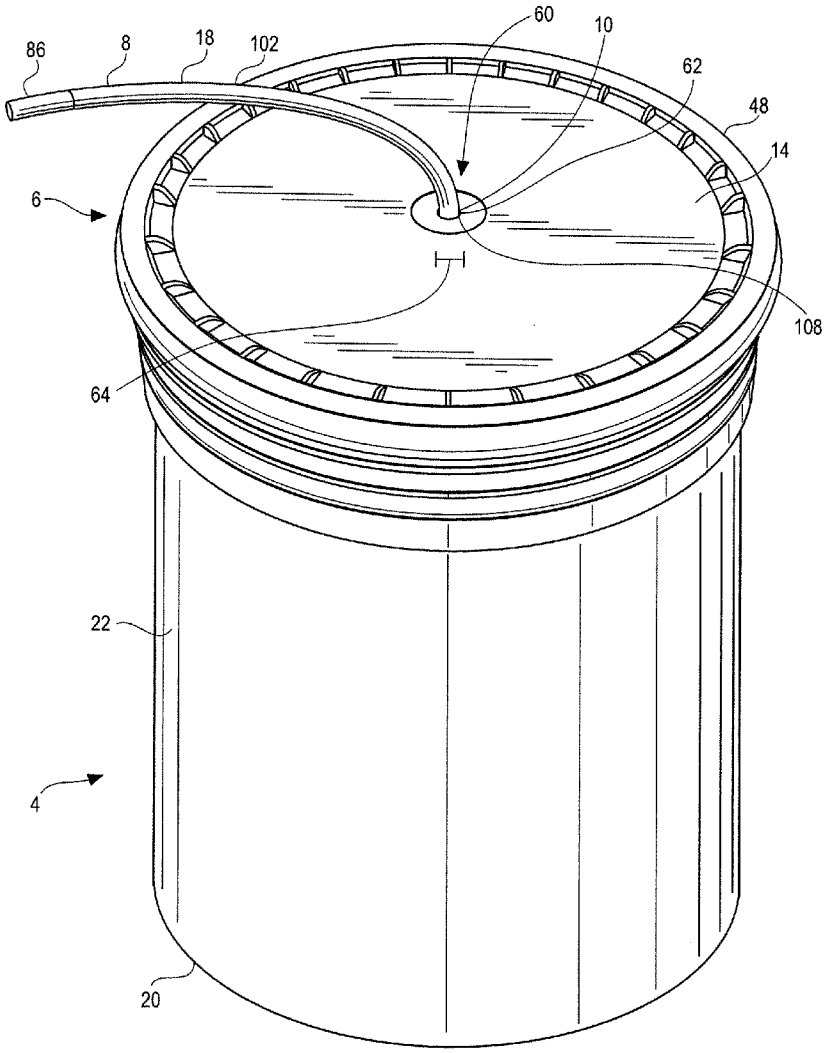
FIG. 1 is a perspective view of a tubing dispenser.

A dispenser is disclosed that provides a convenient and easy-to-use package for storing, organizing, transporting, and dispensing tubing and one or more components or tools for use with the tubing. The dispenser includes a first container having an opening, tubing configured to be disposed in the first container, and a second container configured to be connected to the first container to close the opening. The second container has one or more compartments that contain one or more components or tools for use with the tubing. In one form, substantially all of the components and tools needed for installing or servicing a predetermined type of irrigation system can be provided in the dispenser. The dispenser may then be transported to the worksite and the tubing, components, and/or tools dispensed as needed to install or service the irrigation system. Once the installation or servicing is completed, the dispenser and any uninstalled tubing, components, and/or tools can be easily collected and organized within the dispenser before being transported back to, for example, a homeowner's garage.

In one form, the first container has a rim extending about the opening, the second container has a locking portion configured to releasably engage the rim, and a lid is provided having a locking portion configured to releasably engage the locking portion of the second container. The inter-connecting locking portions of the lid and second container provide stacked locking of the lid to the second container and of the second container to the first container. This provides a compact assembly of the lid, second container, and first container.

A dispenser for tubing and related components is also provided having a first container, a second container configured to be connected to the first container, and at least one opening that opens into one or more compartments of the second container. The second container includes a transparent member covering the at least one opening of the one or more compartments so that the one or more components or tools are visible through the transparent member. The components and tools stored within the dispenser are thereby easily viewed by a user or potential consumer without needing to open or disassemble the dispenser.

In another form, the dispenser provides enhanced handling of tubing as well as components or tools for use with the tubing. The dispenser includes a container having an opening, tubing configured to be disposed within the container, and a tray configured to be connected to the container to close the opening The tray has one or more compartments for receiving one or more components or tools for use with the tubing. Further, the tray has an opening sized to permit a section of tubing to be advanced out of the container. By utilizing a tray having one or more compartments and the tubing opening therein, the tubing can be withdrawn as needed without disturbing the one or more components or tools disposed in the one or more compartments.

Figure 2:
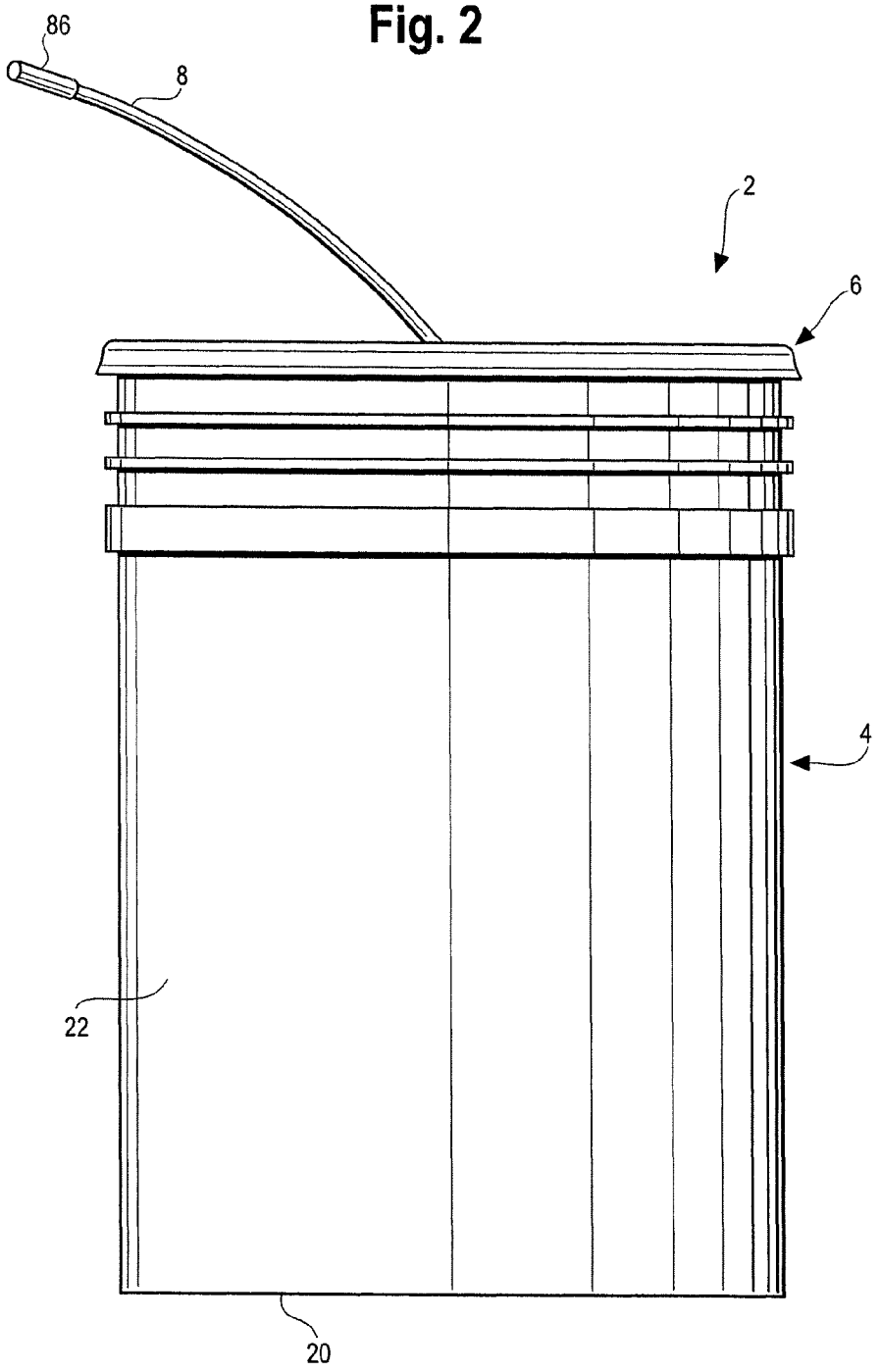
FIG. 2 is side elevational view of the tubing dispenser of FIG. 1.
Figure 3:
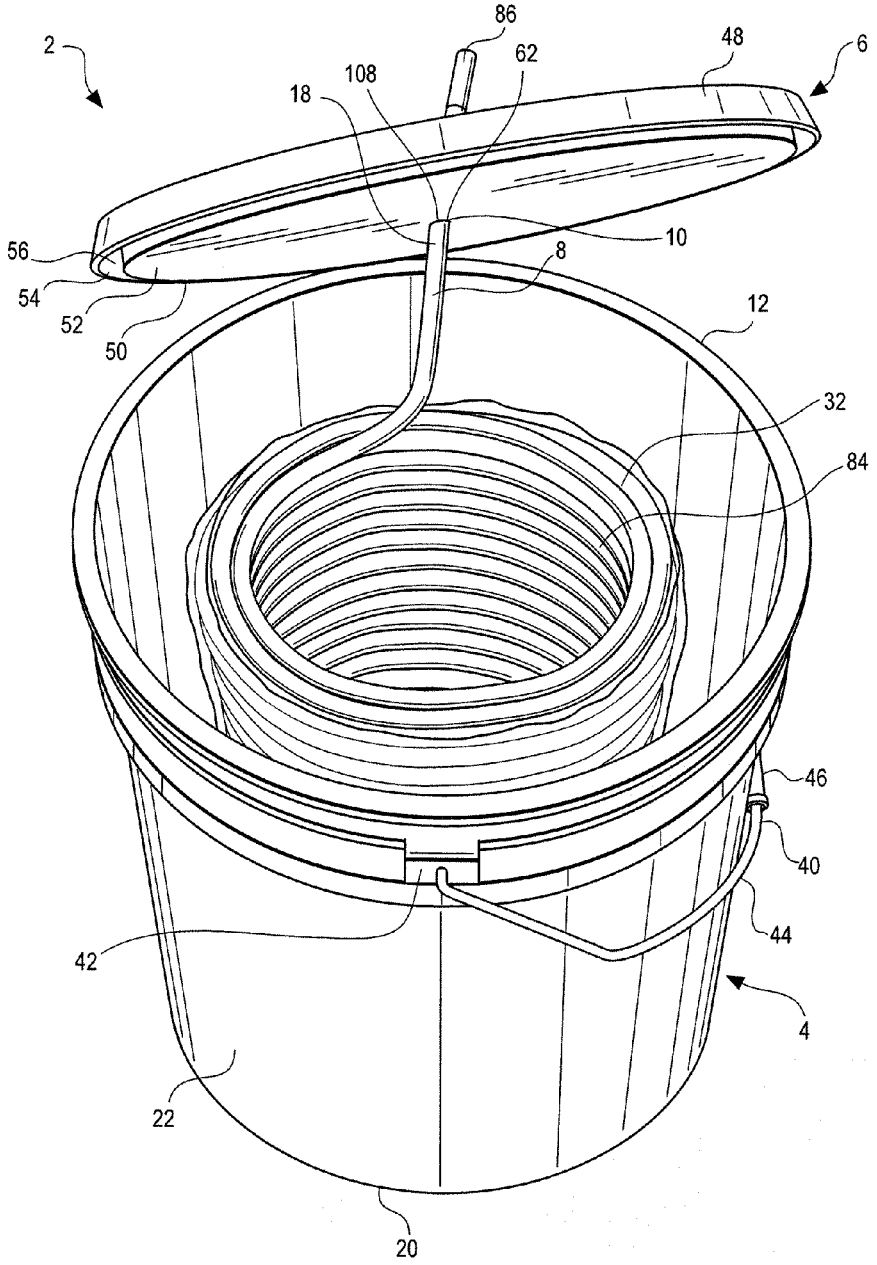
FIG. 3 is a perspective view of the tubing dispenser of FIG. 1 showing tubing located within the dispenser.

In FIGS. 1-3, a tubing dispenser 2 is shown including a container 4, a lid 6, and tubing 8 extending through an aperture 10. In particular, the container 4 receives the tubing 8 (FIG. 3), and the lid 6 engages an upper edge 12 of the container 4 to effectively seal the container 4. The lid 6 includes a central web portion 14. The aperture 10 is configured to receive and dispense the tubing 8 in a controlled manner. The aperture 10 and the outer surface 18 of the tubing 8 are configured to provide controlled dispensation of the tubing 8 and resist unintentional migration or retraction of the tubing 8 into or out of the container 4 through the aperture 10. This aids in cutting the tubing and having a portion readily available to pull another segment of tubing from the dispenser.

The tubing dispenser 2 is operable to provide a reusable container 4 for loading and reloading a coil of tubing 32 therein. The container 4 further provides a sturdy, resilient receptacle which can withstand being exposed to water and/or other elements commonly found during field installation of irrigation tubing. The lid 6 is preferably configured to provide a water tight seal with the container 4, and the container protects the tubing from damage, such as being pinched or crushed.

The container 4 preferably includes a circular bottom portion 20 extending between a cylindrical upstanding sidewall 22. However, other configurations, such as a four-sided, five-sided, six-sided, or eight-sided sidewall construction can be employed, and the bottom portion can be shaped with a corresponding number of edges.

As shown in FIGS. 1-3, 12 and 13, the sidewall 22 further includes a preselected height 24, such as from about 13 inches to about 16 inches, and an inner diameter 26, such as from about 11 inches to about 13 inches. The height 24 and the inner diameter 26 define the volume within the container 4. The inner diameter 26 of the sidewall 22 is configured to be larger than the outer diameter 30 of coiled tubing 32. The difference between the inner diameter 26 of the sidewalls 22 of the container 4 and the outer diameter 30 of the coiled tubing 32 is selected so that the coiled tubing 32 can be freely received and dispensed without undue interference from the sidewall 22. In one configuration, the side walls 22 are configured to provide a radial clearance 34, such as about 1 inch between the sidewall 22 and the outer diameter 30 of the coiled tubing 32, to provide free movement of coiled tubing 32 into and out of the dispenser 2. Alternatively, the inner diameter 26 of the upstanding sidewalls 22 can be configured so that the coiled tubing 32 engages at least a portion of the inner surface 28 of the sidewalls 22 or along substantially the entire inner surface 28 of the sidewalls 22. In one embodiment, the engagement of the sidewalls 22 and the outer edge 30 of the coiled tubing 32 maintains the coiled configuration 32 of the tubing 8.

The sidewall 22 is further configured to have a height 24 from the bottom portion 20, which is greater than the height 36 of the coiled tubing 32 to be received within the container 4. Preferably, the sidewall 22 extends a distance 38 above the coiled tubing 32, such as about 2 inches to about 4 inches. The distance 38 is sufficient to permit the tubing 8 to be effectively withdrawn from the container 4 through the dispensing aperture 10, as will be discussed further below.

Optionally, as shown in FIG. 3, the container 4 includes a transport feature 40 extending from the outer surface 42 of the sidewall 22. The transport feature can be in the form of a handle portion 40 that is configured to be gripped by a user to allow for easy handling and movement of the container 4, particularly with coiled tubing 32 placed within the container 4. As shown in FIG. 3, the handle portion 40 includes a curved elongated member 44 rotatably connected to generally opposite portions of the outer surface 42 of the sidewall 22 of the container 4 and a gripping portion 46 mounted on the curved elongated member. The gripping portion 46 could rotate about and relative to the curved elongate member 44. Alternatively, the handle or gripping portion 40 can include a handle which is integrally formed with or otherwise secured to the side wall, or other known handle and/or gripping configurations.

The upper edge 12 of the container 4 is configured to be engaged by or with the lid 6, thereby securing the lid 6 on the upper edge 12 of the container 4. Further, the engagement between the upper edge 12 and the lid 6 preferably provides a waterproof interface as will be discussed in greater detail below.

The lid 6, as shown in FIGS. 1-3, includes an outer skirt portion 48 extending around the central web portion 14. The skirt portion 48 includes an engaging portion 50 along a lower surface 52 thereof for being secured to the upper edge 12 of the sidewall 22 of the container 4.

The engaging portion 50 of the lid 6 is configured to engage the upper edge 12 of the sidewall 22 and provide a seal therebetween. The engaging portion 50 and upper edge 12 of the sidewall 22 can be configured to include any known engagement mechanism 54, such as opposing annular ribs or annular rib a groove 56 configured to firmly and releasable secure the upper edge 12 of the sidewall 22 therein as shown in FIGS. 1-3, a threaded connection between the upper edge 12 and the engaging portion 50, manual securing members such as a clasp, and depending tabs of the lid 6 configured to engage depressions of the outer surface 42 of the sidewalls 22.

Figure 13:
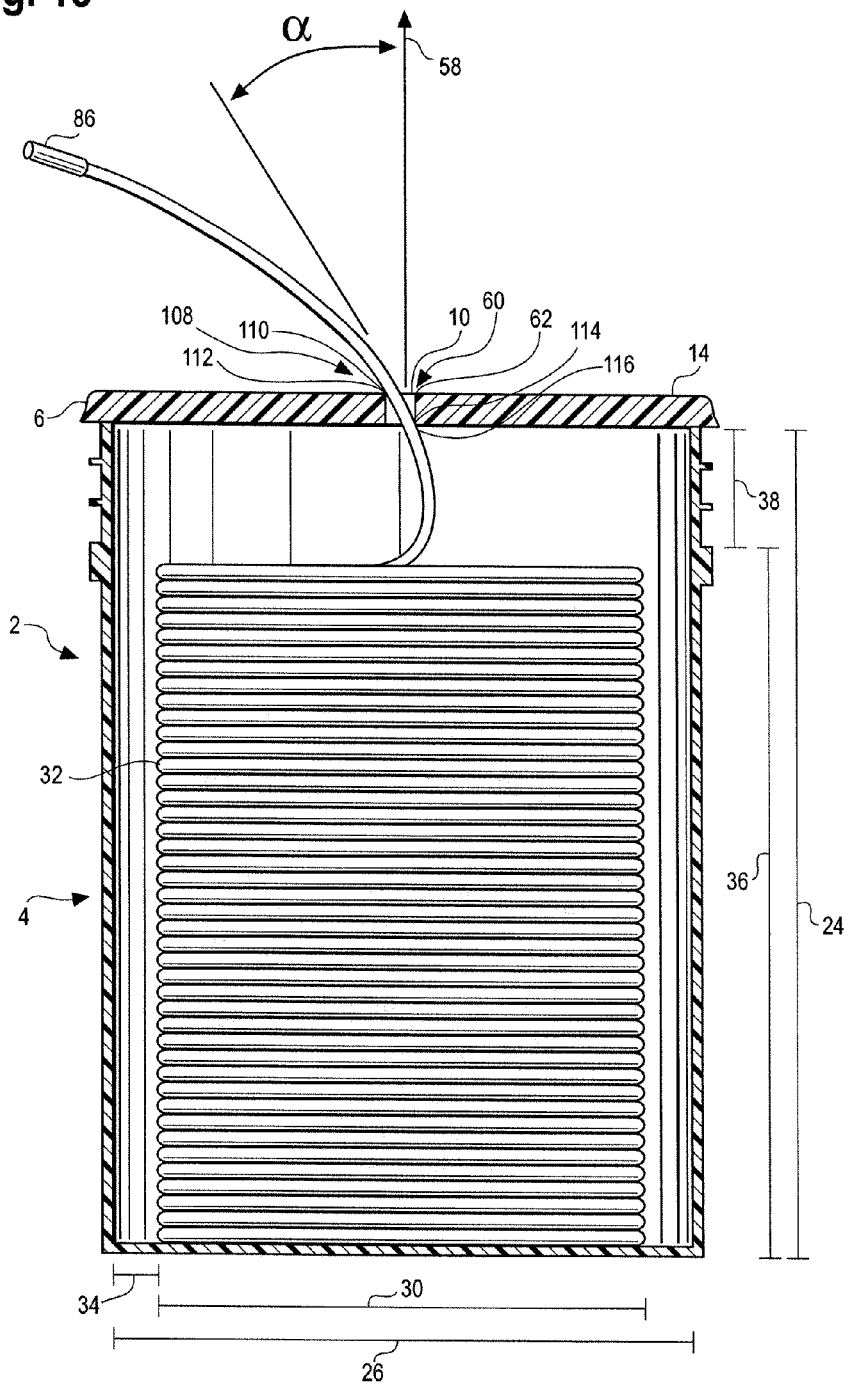
FIG. 13 is a cross-sectional view of the tubing dispenser of FIG. 1 showing tubing and an angle at which tubing extends through a dispensing aperture.

The aperture 10 of the tubing dispenser 2 is configured to receive the tubing 8 therein and permit controlled dispensation of the tubing 8 from the container 4. The aperture 10 can be located at any suitable location in the tubing dispenser 2, such as, but not limited to, the bottom portion 20 of the container 4, the upstanding sidewalls 22 of the container, or the lid 6. Preferably, the aperture 10 is located so that the tubing 8 can freely pass therethrough and extends at an angle alpha obliquely to the longitudinal axis 58 of the sidewall 22 of the container 4, as shown in FIG. 13. Preferably, alpha ranges from at least 0 degrees to about 60 degrees, preferably 15 degrees to 45 degrees.

In one embodiment, as shown in FIGS. 1-3, the lid 6 defines the circular aperture 10 in the central web portion 14 at a generally central portion 60 of the lid 6; however, the aperture 10 can be located at a non-central area of the lid 6.

The aperture 10 is defined by an aperture edge 62. In a preferred embodiment, the aperture 10 has a diameter 64 of about 0.0625 inches larger than the outer diameter 66 of the tubing 8.

Figure 11A:
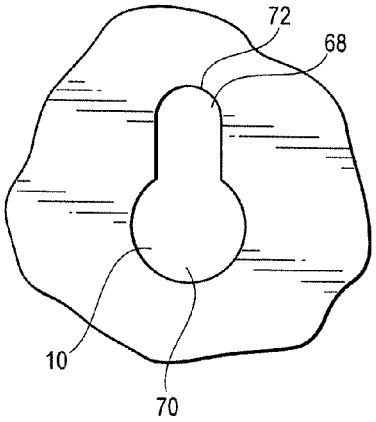
FIG. 11A is a plan view of the tubing dispenser showing an alternative dispensing aperture.
Figure 11B:
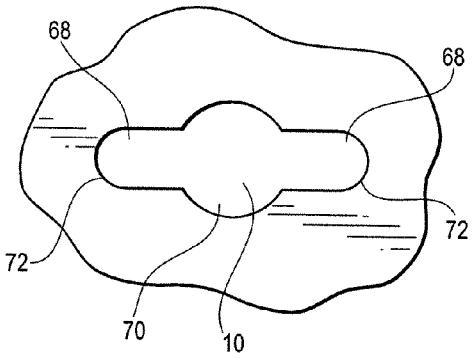
FIG. 11B is a plan view of the tubing dispenser showing another alternative dispensing aperture.

In an alternative configuration, as shown in FIGS. 11A and 11B, the aperture 10 can take the form of a keyway with a neck portion 68 extending from a head portion 70. The head portion 70 is configured to receive and dispense the tubing 8, such as aperture 10 described above. The neck portion 68 is configured to receive the tubing 8 therein and engage the outer surface 18 of the tubing 8 to secure the tubing 8 against inadvertent dispensing from or retraction into the container 4. The neck portion 68 further is configured to include a smaller opening than the head portion 70 of the aperture 10, but configured large enough for the tubing 8 to be received therein. As shown in FIGS. 11A and 11B, the neck portion 68 has semi-oval-like configuration 72. Further, as shown in FIG. 11B, the aperture 10 can include two neck portions 68 extending in different directions from the head portion 70. Preferably, the neck portions 68 are spaced equally around the head portion 70, such as 180 degrees apart.

Figure 11C:
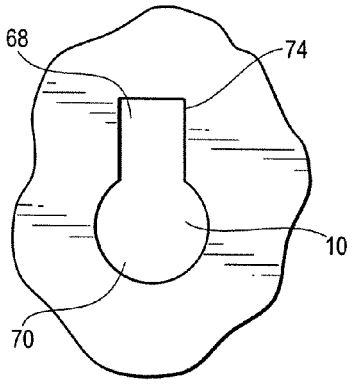
FIG. 11C is a plan view of the tubing dispenser showing another alternative dispensing aperture.
Figure 11D:
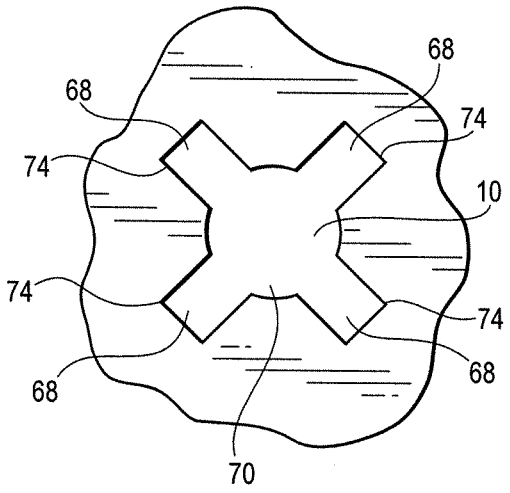
FIG. 11D is a plan view of the tubing dispenser showing another alternative dispensing aperture.

In an alternative configuration, as shown in FIGS. 11C and 11D, the neck portion or portions 68 extending from the head portion 70 have a generally rectangular shape defined by the edge 74. FIG. 11C shows an aperture 10 having a keyhole arrangement similar to FIG. 11A. FIG. 11D shows an aperture 10 having a head portion 70 and four neck portions 68 extending in different directions from the head portion 70. As in FIG. 11B, the neck portions 68 are preferably spaced equally around the head portion, such as 90 degrees apart.

Figure 11E:
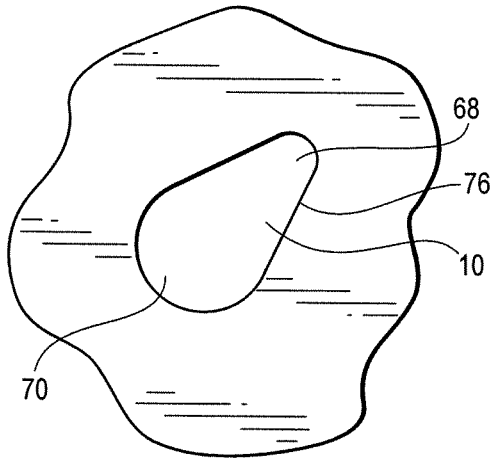
FIG. 11E is a plan view of the tubing dispenser showing another alternative dispensing aperture.

Other configurations of the neck portion 68 are contemplated, including multiple neck portions 68 and other neck portion edge configurations. Further, as shown in FIG. 11E, the aperture edge 76 can be configured to taper from the head portion 70 to the neck portion 68. In this embodiment, the head portion 70 has an arcuate section with a radius of curvature greater than that of an arcuate section of the neck portion. The two arcuate sections are separated by linear edges. The linear edges grip the tubing end portion to secure it against unintentional retraction and dispensing.

Figure 15:
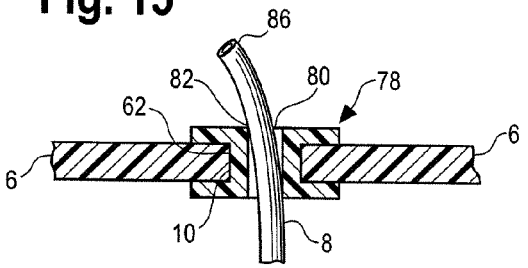
FIG. 15 is a side cross-sectional view of the aperture in the lid, a grommet positioned within the aperture and the tubing extending through the central opening of the grommet.

In a further embodiment, as shown in FIG. 15, the aperture 10 includes a grommet 78 therein. The grommet 78 preferably is made of a resilient material, such as rubber, and includes an opening 80. The opening 80 is configured to receive the tubing 8 therein and permit controlled dispensation of the tubing 8 through the grommet 78. Further, the grommet 80 and tubing 8 are preferably configured to provide a generally water tight seal 82 therebetween.

Preferably, the tubing dispenser 2 includes the aperture 10 pre-formed therein. However, the aperture 10 can be made by any known methods, such as by cutting or drilling at the point of first use.

The tubing dispenser 2 can further include an aperture plug or cap configured to cover, or substantially cover the aperture 10. The aperture plug or cap can be located on either the outside of the tubing dispenser 2 or on the inside of the tubing dispenser 2, preferably along the outside of the tubing dispenser 2. The aperture plug or cap can be removable or replaceable with respect to the tubing dispenser 2. Examples of removable aperture plugs or caps include, but are not limited to, a member configured to extend across the aperture 10 and affixed to the tubing dispenser 2 by an adhesive, a portion of the tubing dispenser 2 having a perforated edge which may be forcibly removed, or a rubber plug fitted into the aperture. Exemplary removable aperture plugs or caps include a snapped or threaded connection to allow the cover to be releasably attached to the tubing dispenser 2.

Figure 6:
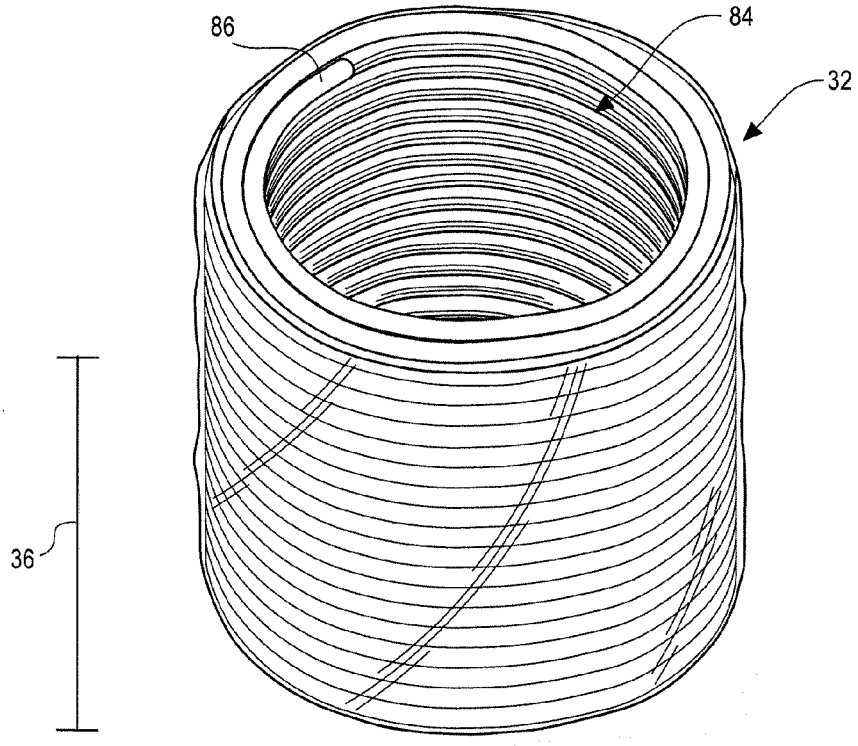
FIG. 6 is a perspective view of coiled tubing secured by an outer wrap.

As shown in FIGS. 3, 6 and 13, the coiled tubing 32 is configured to be coiled around a generally central void or opening 84. The coiled tubing 32 has an outer diameter 30 configured to be less than or generally equal to the inner diameter 26 of the sidewall 22 of the container 4. In addition, the coiled tubing 32 has a height 36 which is less than the height 24 of the sidewall 22 of the container 4. The coiled tubing 32 further includes a free end 86 thereof extending from the central void 84. The coiled tubing 32 is further configured such that the free end 86 can be pulled or withdrawn from the coiled tubing 32 with the application of minimal force, additional tubing being withdrawn from the central void 84 of the coiled tubing 32 so that the central void 84 increases in size as the tubing 8 is withdrawn. In other words, the preferred coiled tubing 32 unwinds generally from the inner region first. In this case, any shrink wrap holding the coiled tubing 32 together can remain on the tubing when in the dispenser 2. The shrink wrap can be removed from the dispenser 2 when all of the tubing 8 has been dispensed and a new coil 32 is being loaded. Alternatively, the coiled tubing 32 can be placed within the container 4 without an outer wrap, such as shrink wrap. The coiled tubing 32 is configured to self-unwind so that the outer diameter 30 of the coiled tubing 32 expands until the coiled tubing 32 engages the inner surface 28 of the sidewall 22 of the container, the sidewall 22 configured to restrict further expansion of the outer diameter 30 of the coiled tubing 32.

Figure 4:
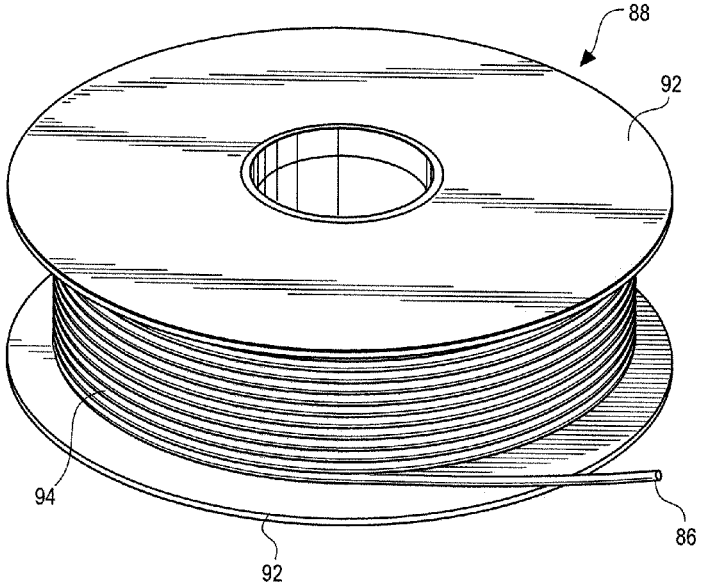
FIG. 4 is a perspective view of tubing wrapped around a spool.
Figure 5:
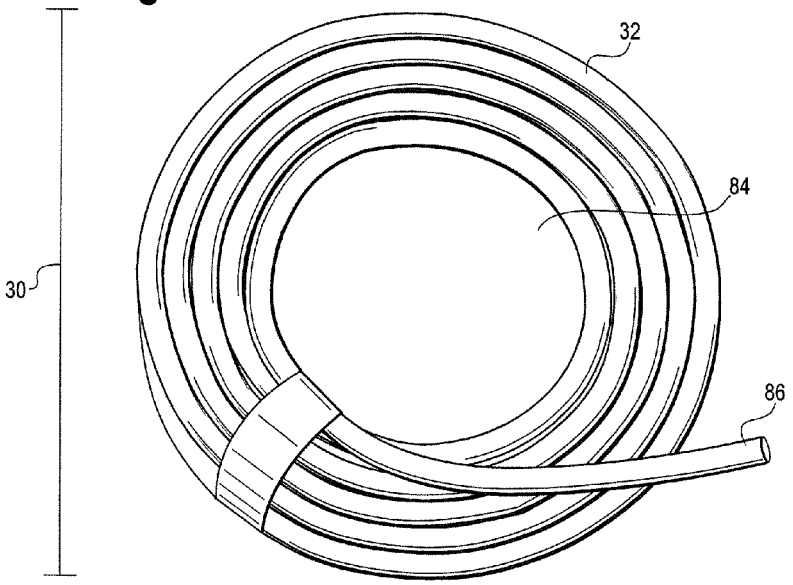
FIG. 5 is a top view of coiled tubing secured by a band.
Figure 14:
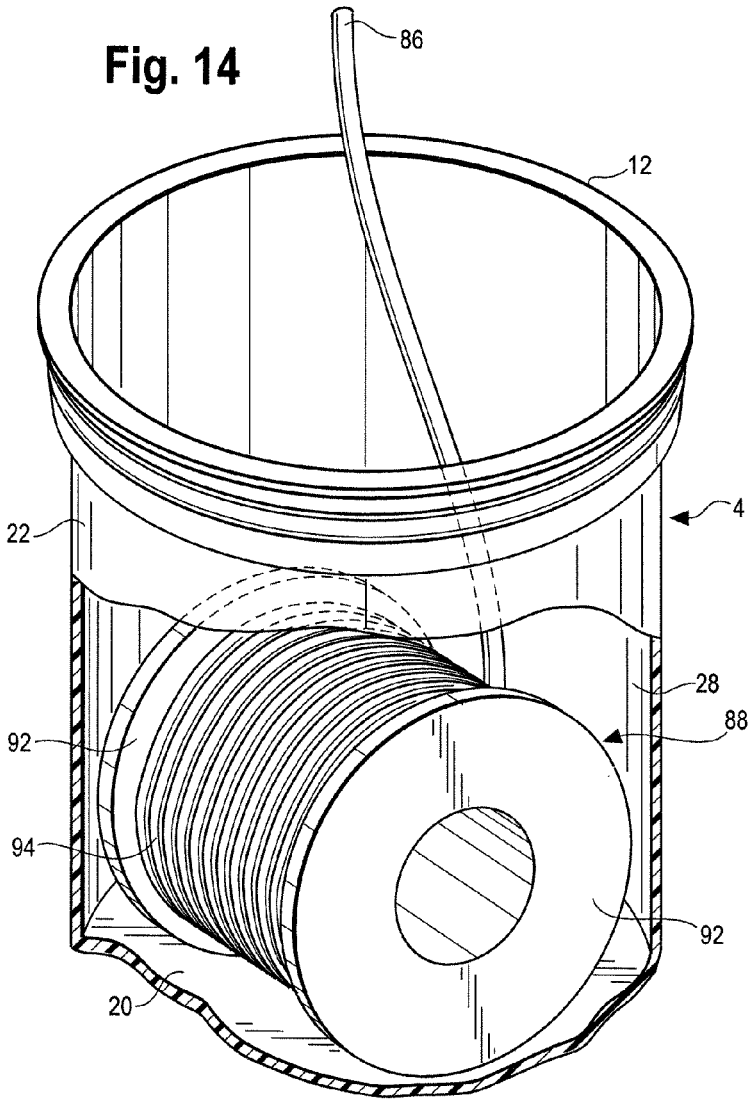
FIG. 14 is a perspective view of the tubing dispenser of FIG. 1 showing the container in break away and spooled tubing within the container.

Alternatively, the container 4 is configured to receive spooled tubing 88 therein, as shown in FIGS. 4 and 14. The spooled tubing 88 is oriented in the container 4 such that the flanges or rims 92 of the spooled tubing 88 are oriented to extend from the bottom portion 20 of the container toward the upper edge 12 of the sidewalls 22. The spooled tubing 88 is configured such that the free end 86 of the tubing 8 extends from the outer edge 94 of the spooled tubing 88. The container 4 and the spooled tubing 88 are configured such that, as the free end 86 of the tubing 8 is pulled away from the spooled tubing 88 the spooled tubing 88 rotates within the container such that the flanges 92 rotate along at least the bottom portion 20 of the container, and possibly along the inner surface 28 of the container sidewalls 22. Preferably, the flanges 92 and the container 4 are configured to reduce friction therebetween. In one embodiment, at least one of the bottom portion 20 of the container 4 and the flanges 92 are coated with a friction-reducing coating, such as Teflon. Alternatively, the bottom portion 20 of the container 4 includes grooves configured to receive the flanges 92 of the spooled tubing 88 therein. Further, the grooves can include a friction reducing mechanism, such as ball bearings, to reduce friction between the spooled tubing 88 and the container 4 and permit free rotation of the spooled tubing within the container 4.

Figure 12:
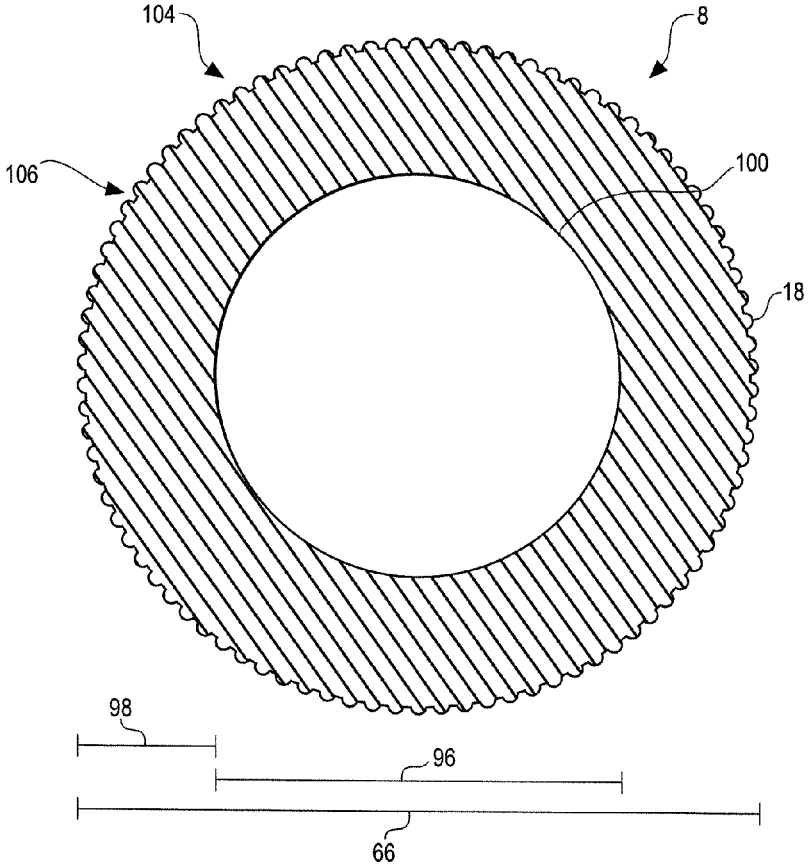
FIG. 12 is cross-sectional view of tubing showing a textured outer surface.

The tubing 8 comprises a plastic suitable for irrigation tubing. Preferably, the tubing 8 is polyethylene. As shown in FIG. 12, the tubing 8 includes a tubing inner diameter 96 and a tubing outer diameter 66. The difference between the inner diameter 96 and outer diameter 66 defines the wall thickness 98 of the tubing 8. As discussed above, the outer diameter 66 of the tubing 8 is configured so as to be receivable within the aperture 10. Preferably, the tubing has an outer diameter 66 of about 0.25" however, other tubing diameters are contemplated. The tubing wall thickness 98 is configured so that the tubing 8 can be coiled and withdrawn from the container 4.

The tubing 8 further comprises an inner surface 100 and an outer surface 18. Generally, the inner surface 100 is substantially smooth, so as to minimize the pressure drop of any fluid passing through the tubing 8. The outer surface 18 can be smooth 102, or can include a textured surface 104. The textured surface 104 of the tubing 8 can include ridges, bumps, or teeth. As shown in FIG. 12, the textured outer surface 18 has surface roughness 106 defined by the peaks and valleys thereof of about 0.015 inches, such as described in Mold-Tech standard MT11020. Further, the textured surface 104 provides a gripping surface for the user, allowing the user to better grasp the tubing 8, withdraw the tubing 8 from the container 4 during dispensing, and forcefully connect the tubing 8 to connection pieces, such as valves and sprinkler heads. The textured outer surface 18 is of a density that provides a water tight seal with connecting members which may receive the tubing 8 therein. Further, unlike tubing 8 having a smooth outer surface 102 which tends to reflect light and, therefore, is noticeable when used in a surface irrigation application, such as in a garden, the textured surface 104 diffuses reflection such that the textured tubing blends into its surroundings.

Figure 7:
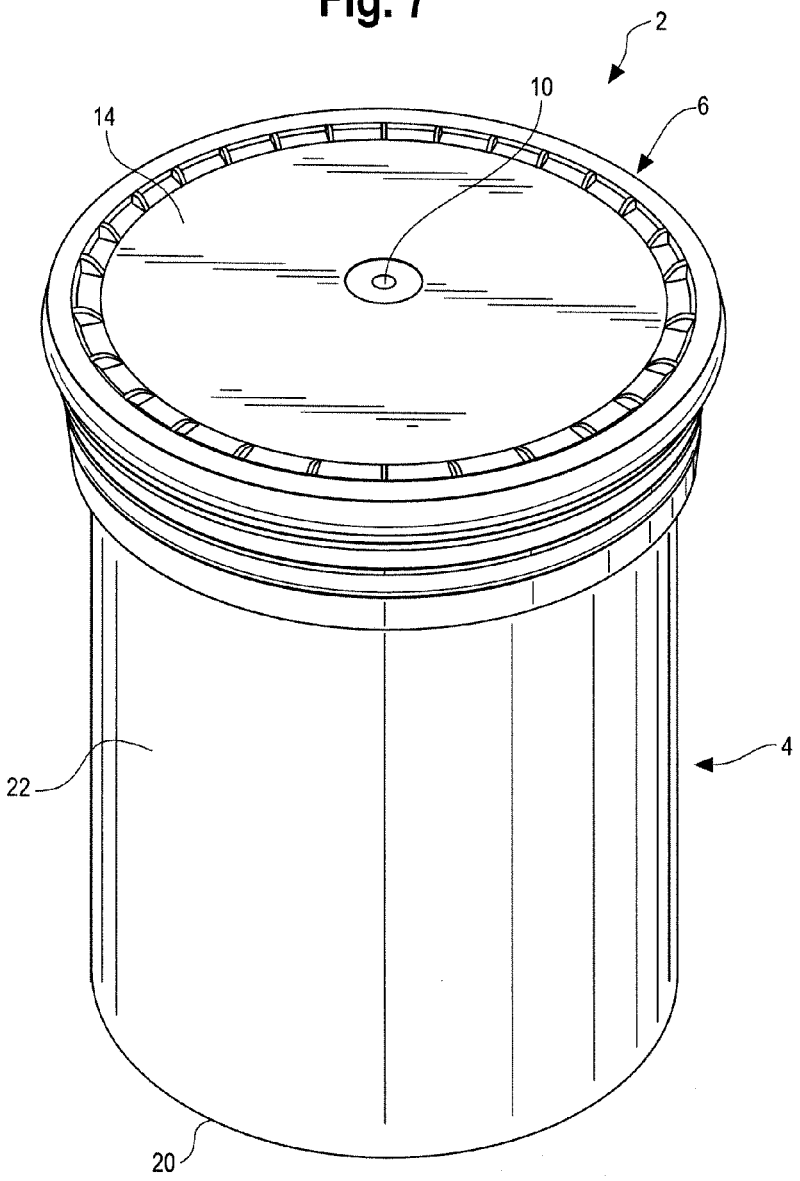
FIG. 7 is perspective view of the tubing dispenser.
Figure 8:
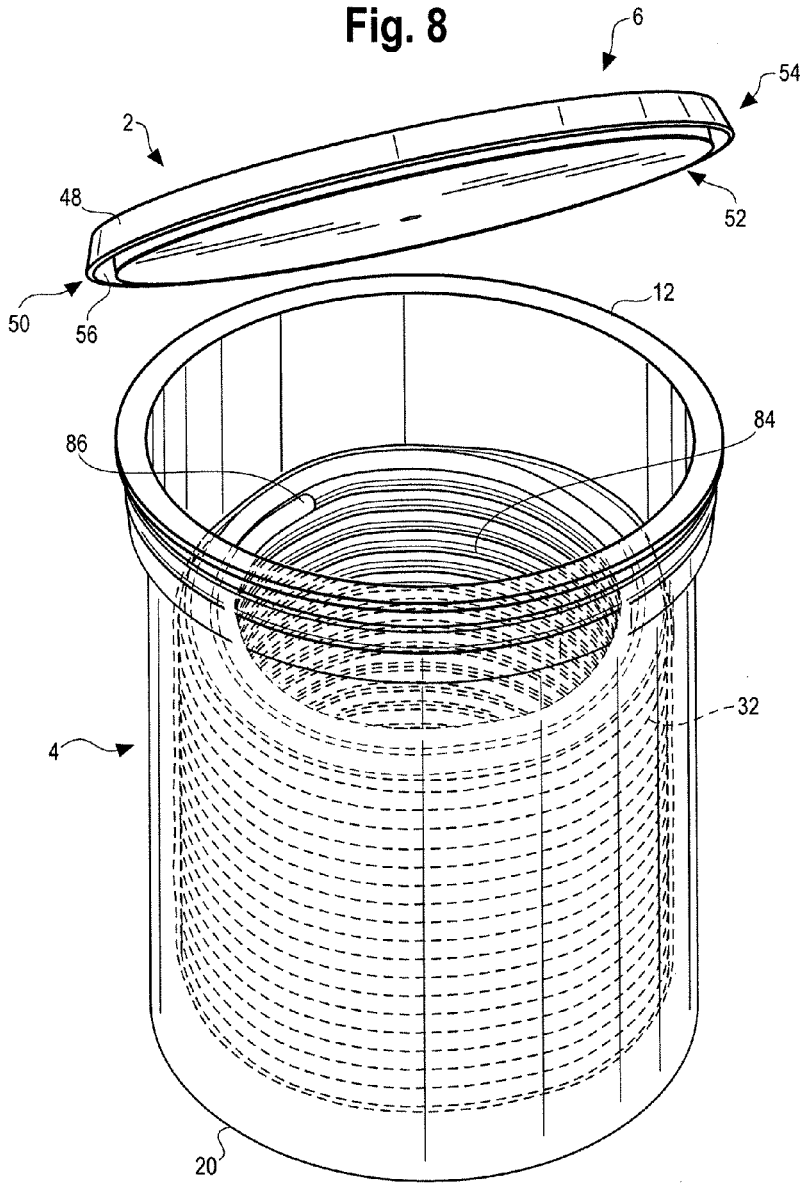
FIG. 8 is a perspective view of the dispenser opened to show a portion of the tubing through the top and a portion of the tubing is also shown in phantom.
Figure 9:
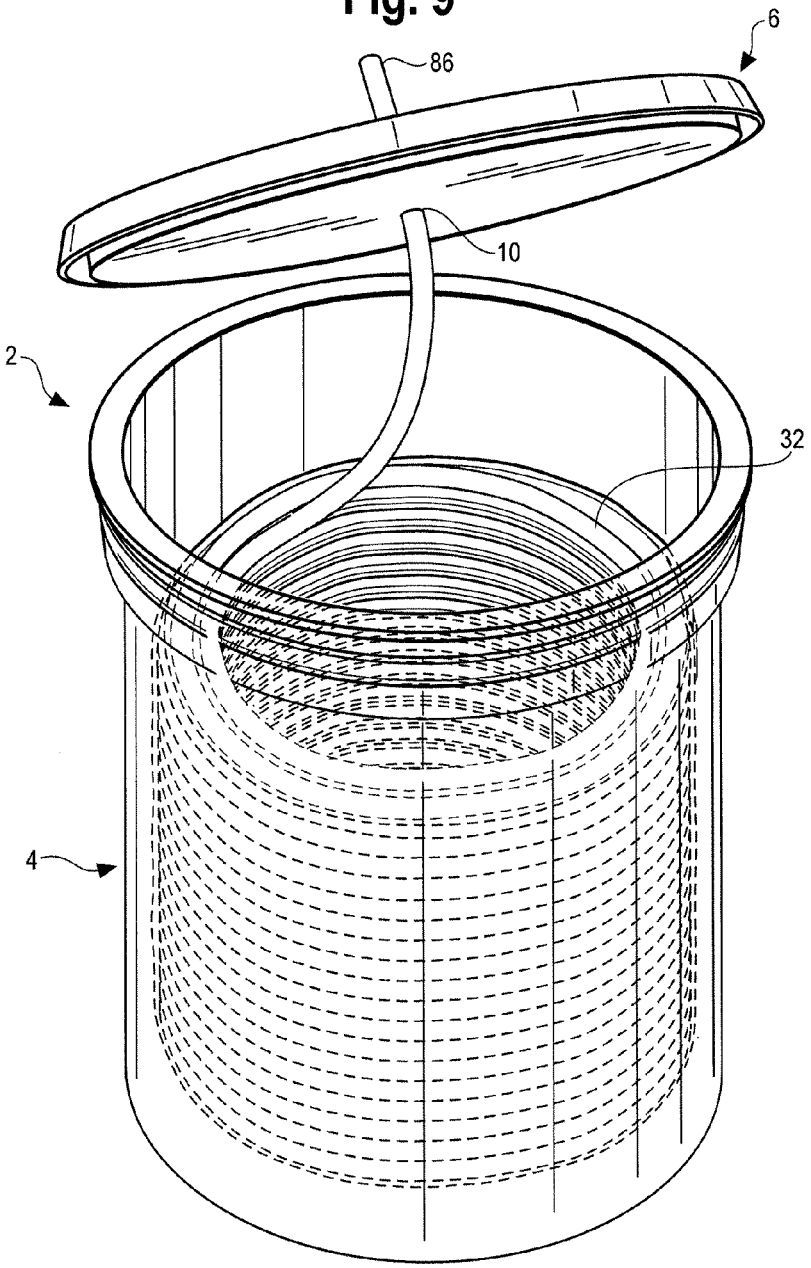
FIG. 9 is a perspective view of the dispenser with a portion of the tubing shown in phantom and a free end of the tubing extending through an aperture of the dispensing lid.
Figure 10:
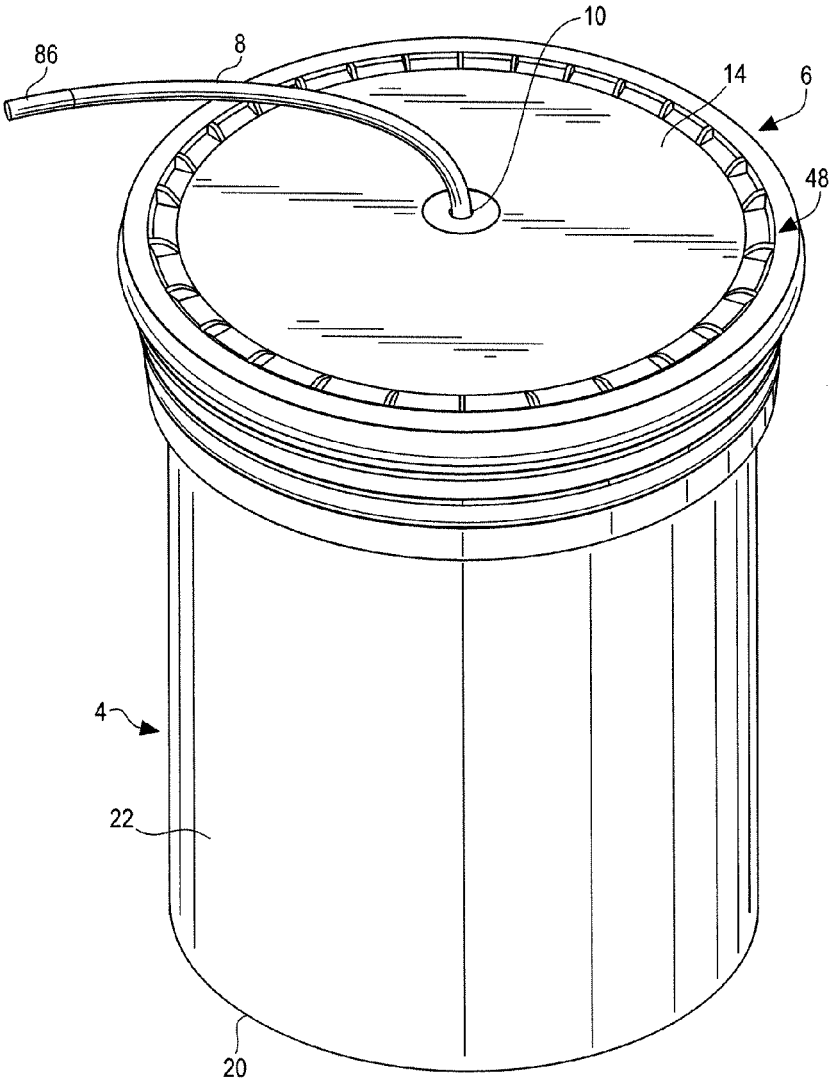
FIG. 10 is a perspective view of the dispenser with a free end of the tubing extending through a dispensing aperture.

The steps of loading and reloading coiled tubing 32 into the container 4 are illustrated in FIGS. 7-10. The first step includes opening the dispenser 2, such as by removing the lid 6 from the container 4 as shown in FIGS. 7-8. This includes unlatching the lid's engagement structure that prevents the lid 6 from unintentional removal. The second step, as shown in FIG. 8, includes placing the coiled tubing 32 within the tubing dispenser 2. Next, as shown in FIG. 9, the free end 86 of the coiled tubing 32 is fed through the aperture 10. Finally, the dispenser is closed, such as shown in FIG. 10 wherein the lid 6 is shifted toward the upper edge 12 of the sidewalls 22 of the container 4 and attached thereto.

To utilize the tubing 8 for controlled dispensing, the tubing 8 is shifted, if necessary, such that the tubing 8 extends through a head portion 70 of the aperture 10. The tubing 8 is grasped adjacent the free end 86 and pulled away from the container 4, such that the at least a portion of the tubing 8 is withdrawn from the container 4. Once the tubing 8 is withdrawn to the desired length, the tubing 8 can then be readjusted within the aperture 10, if necessary, so that the tubing 8 is received in a neck portion 68 of the aperture 10 to provide a quick lock of the tube end 86. Tubing 8 can then be cut to the appropriate length, thereby creating a new free end 86 of the tubing 8 extending out from and above the lid 6 of the container 4.

Retraction or migration of the tubing 8 into the container 4 is resisted or prevented by a frictional engagement 108 between the tubing 8 and the aperture edge 62. When the aperture 10 includes a neck portion 68, such as shown in FIGS. 11A-11D, the neck portion 68 engages the outer edge 18 of the tubing 8 with a tighter grip and resists or prevents retraction or migration of the tubing 8 both out of and in to the container 4. Alternatively, as shown in FIGS. 1-3, the outer surface 18 of the tubing 8 and the aperture edge 62 are configured to provide a frictional engagement 108 between the outer surface 18 of the tubing 8 and the aperture edge 62 to provide controlled dispensing of the tubing 8. This frictional engagement 108 balances between being able to effectively aid tube dispensing when desired, on the one hand, and providing sufficient resistance against unintentional retraction and dispensing of the tubing 8, on the other hand.

Further, the angle alpha ($\alpha$) at which the tubing 8 is canted and extends through the aperture 10 is selected to maximize contact between the aperture edge 62 and the outer surface 18 of the tubing 8. As shown in FIG. 13, angle alpha is selected so that a lower surface portion 110 of the tubing 8 engages an upper surface portion 112 of the aperture edge 62, and an upper surface portion 114 of the tubing 8 engages a lower surface portion 116 of the aperture edge 62. As a result, the area of frictional engagement 108 increases, thereby further resisting movement of the tubing 8. Further, the tubing 8 is urged downwardly due to gravity and the pre-bend of the tubing from being coiled and resilient, and as a result, the engagement of the aperture edge 62 and outer surface 18 of the tubing 8 acts as a lever. More specifically, the lower surface portion 110 of the tubing 8 is urged into engagement with the upper surface portion 112 of the aperture edge 62, and the upper surface portion 114 of the tubing 8 is urged into engagement with the lower surface portion 116 of the aperture edge 62. This further resists retraction or other unintentional movement of the tubing 8.

With reference to FIGS. 16-23, a dispenser 200 is shown that is similar in many respects to the dispenser 2 disclosed above such that differences between the dispenser 200 and the dispenser 2 will be highlighted. The dispenser 200 includes a first container 202 for receiving tubing, a second container, such as tray 204, for storing components 206 and a tool 208 for use with the tubing, and a lid 210 which closes the tray 204 and retains the components 206 and tool 208 within the tray 204 (see FIG. 18). Although the tray 204 is shown with more than one component 206 and a single tool 208, it will be appreciated that the tray 204 could have only one component 206 and one tool 208, one component 206 and more than one tool 208, no components 206 and more than one tool 208, etc.

Figure 17:
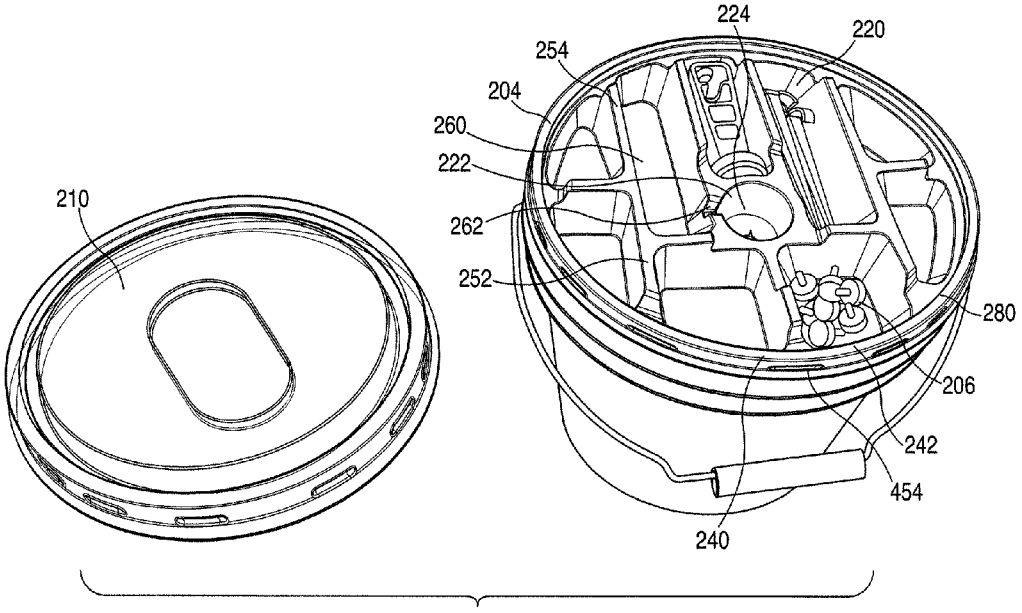
FIG. 17 is a partially exploded view of the dispenser of FIG. 16 showing a lid of the container removed.

With reference to FIG. 17, the tray 204 has one or more compartments 220 adapted to receive and organize the irrigation components 206 and tool 208 in a manner that permits easy selection and removal of the components 206 and tool 208 from the tray 204. The tray compartments 220 includes a tubing compartment 222 with a dispensing aperture 224 disposed therein (see FIG. 22). The dispensing aperture 224 permits a section 230 of tubing 232 to be withdrawn from within the container 202 (see FIGS. 19-21) once the lid 210 has been removed from the tray 204. This permits a user to easily draw out a desired length of the tubing 232, cut the tubing 232, and use the cut tubing 232 with one or more of the irrigation components 206 and tool 208 as may be desired.

Figure 18:
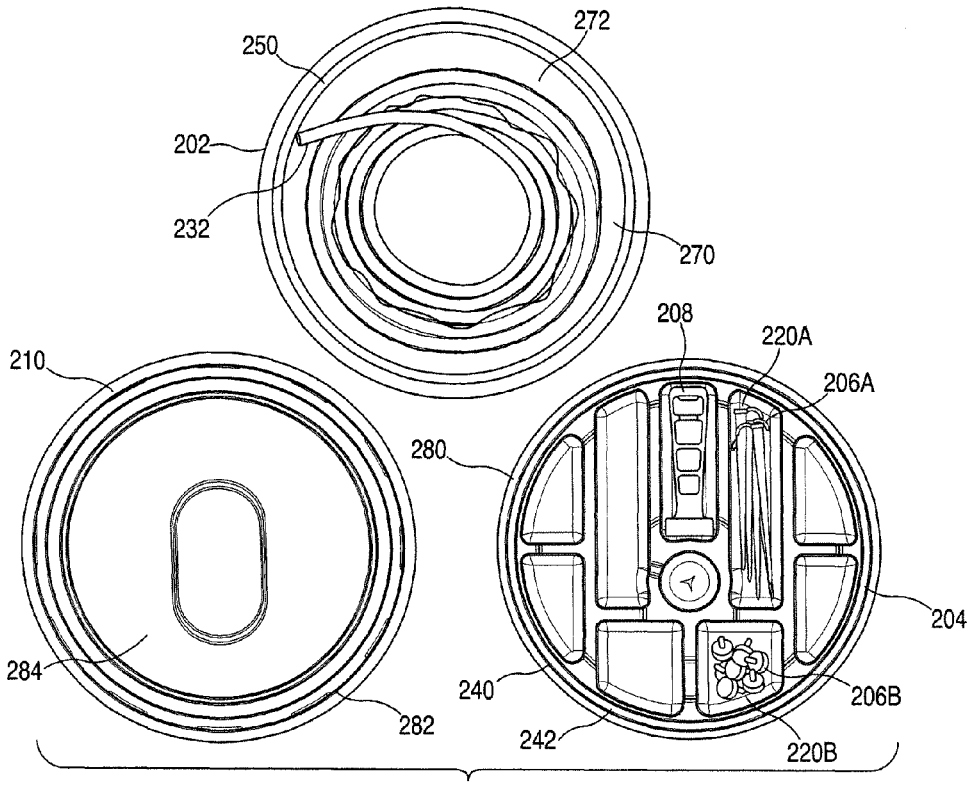
FIG. 18 is an exploded view of the dispenser of FIG. 16 showing the lid, a tray, and a container of the dispenser.

The tray 204 has an outer portion 240 with a skirt 242 configured to releaseably engage a rim 250 of the container 202, as shown in FIGS. 17 and 18. The tray 204 also has an inner portion 252 with divider walls 254 that form the compartments 220. Each compartment 220 has an opening 260 defined at least in part by the divider walls 254 that permits the irrigation components 206 and tool 208 to be inserted into or removed from the compartments 220. In addition to defining the general shape of the compartments 220, the divider walls 254 also serve to keep the components 206 and tool 208 organized by restricting mixing of the components 206 and tool 208.

In one approach, the walls 254 of each compartment 220 are sized and configured to provide a compartment 220 that is tailored to a particular component 206 or tool 208 desired to be received therein. For example, compartment 220A is relatively elongated and may be configured to receive corresponding elongated irrigation components 206A (see FIG. 18); by contrast, a compartment 220B may be more square to receive shorter irrigation components 206B. The components 206 and tool 208 may include components and tools for a particular type of irrigation system, such as a drip irrigation system. For example, the components 206 could include one or more of each of the following components: faucet adapter and filter, tubing stake, bug caps, spot watering emitters, tubing plug, barbed tee, barbed coupling; and the tool 208 could include one or more of an emitter installation tool and a tubing cutting device. With respect to FIG. 18, the components 206A could be tubing stakes, and the components 206B could be emitters, as an example.

Figure 22:
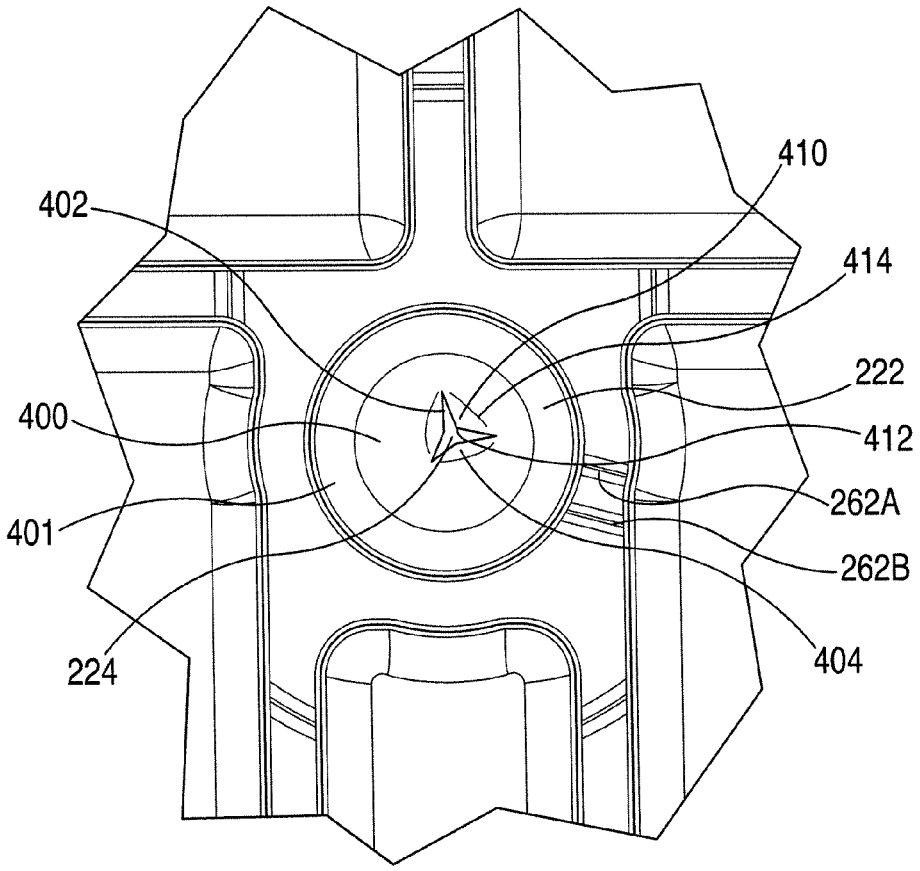
FIG. 22 is a plan view of the dispensing aperture of the tray.
Figure 23:
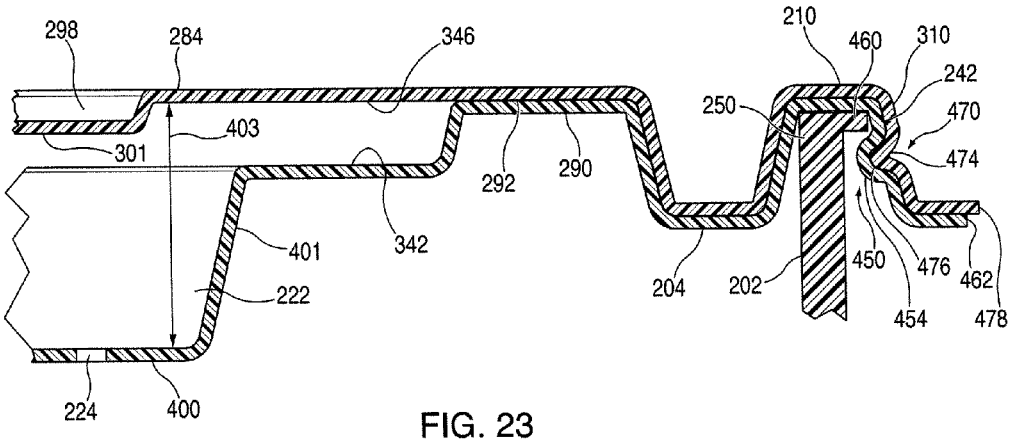
FIG. 23 is a cross-sectional view taken across line 23-23 in FIG. 16.

The tubing compartment 222 has a recessed floor 400 and a divider wall 401 upstanding therefrom, as shown in FIGS. 17, 22, and 23. The dispensing aperture 224 is formed in the floor 400 and is spaced from the lid 210 by a distance 403, as shown in FIG. 23. The distance 403 permits a short length of the tubing 232 to be drawn up through the aperture 224 and positioned in the tubing compartment 222. For example, once the dispenser 200 is initially opened and the tubing section 230 fed through the aperture 224 (see FIG. 19), a user may cut off a desired length of tubing 232, then position the remaining length of tubing 232 (i.e., the section of tubing 232 still extending through the aperture 224) within the tubing compartment 222. Next, the lid 210 can be connected to the tray 204, and the dispenser 200 moved to a different location or placed into storage. This allows a user to dispense a desired length of tubing 232, replace the lid 210, then dispense another length of tubing 232 without having to re-feed the tubing 232 through the aperture 224 each time. The recessed configuration of the tubing compartment 222 allows enough of the tubing 232 to protrude upward above the aperture 224 so that a user can easily grasp the protruding tubing 232. The recessed tubing compartment 22 also restricts the tubing 232 from interfering and pushing upward on the lid 210.

With reference to FIG. 17, the tubing compartment 224 may have a generally rounded configuration to accommodate a range of motion of the tubing 232 as it is drawn outward from the container 202. The tubing compartment 224 is also preferably formed at or near the center of the tray 204 in order to minimize off-center forces produced by pulling the tubing 232 outward through the dispensing aperture 224. These forces may be due to frictional engagement between the dispensing aperture 224 and the tubing 232 that tends to resist movement of the tubing 232, as will be discussed in greater detail below. By minimizing the off-center forces, the dispenser 200 is less likely to tip over when tubing 232 is withdrawn outward from the container 202 and through the dispensing aperture 224.

As shown in FIG. 17, the tray 204 has a channel 262 extending outwardly from the tubing compartment 222 that can be used to temporarily restrain a length of tubing 232 after it has been withdrawn through the dispensing aperture 224. The channel 262 has a pair of walls 262A, 262B with a width therebetween slightly smaller than the outer diameter of the tubing 232, as shown in FIG. 22. The length of tubing 232 can be pressed into the channel 262, which causes the walls 262A, 262B to partially compress the tubing 232 and creates a friction fit between the walls 262A, 262B and the tubing 232. This temporarily holds the tubing 232 in position until the tubing 232 is pulled outward from the channel 262, which disengages the tubing 232 from the walls 262A, 262B.

With reference to FIG. 18, the container 202, tray 204, and lid 210 are illustrated in an exploded configuration which shows pre-coiled tubing 232 disposed within the container 202. As discussed above, the tubing 232 may have an outer flexible wrap which maintains the tubing 232 in a pre-coiled configuration for ease of handling. The container 202 has an inner volume 270 sized to receive the coiled tubing 232 and an opening 272 through which the tubing 232 may be inserted into the inner volume 270. As discussed above, the tray skirt 242 releaseably engages the container rim 250 and permits the tray 204 to be connected to the container 202 in a manner that closes the opening 272 and restricts removal of the pre-coiled bundle of tubing 232.

Similarly, the tray outer portion 240 includes a rim 280 and the lid 210 has an outer portion 282 configured to releaseably engage the tray rim 280, as shown in FIG. 18. The lid 210 also has an inner portion 284 that covers the tray 204 and, in one form, the inner portion 284 closes one or more of the compartment openings 260 to retain one or more of the components 206 and tool 208 within the compartments 220 (see FIGS. 16 and 17). Further, the lid 210 may be transparent so that a potential purchaser of the dispenser 200 can visually view the irrigation components 206 and tool 208 within the compartments 220. In one form, the tray 204 positions the components 206 and tool 208 generally in a common plane beneath the transparent lid 210. This provides a pleasing aesthetic appearance of the dispenser 200 as well as permits a potential purchaser to visually identify the different components 206 and tool(s) 208 held in the tray 204, which both are significant advantages in a retail environment for the dispenser 200.

Figure 20:
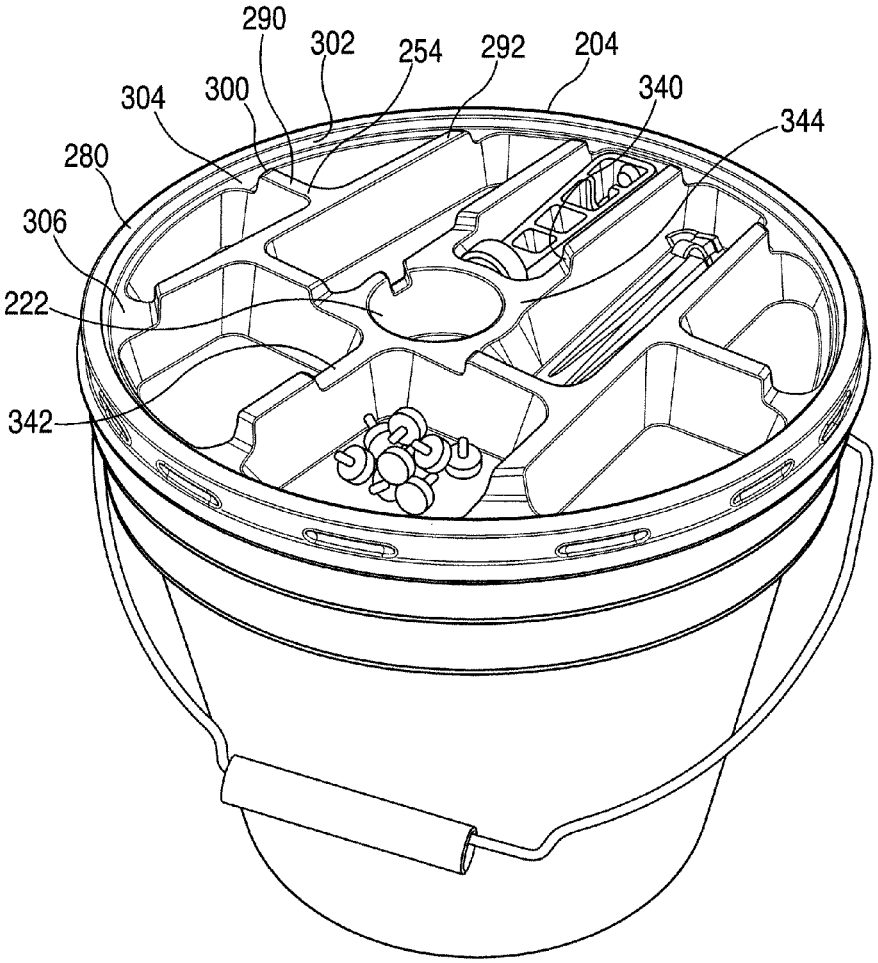
FIG. 20 is a perspective view of the dispenser of FIG. 16 with the lid removed.
Figure 21:
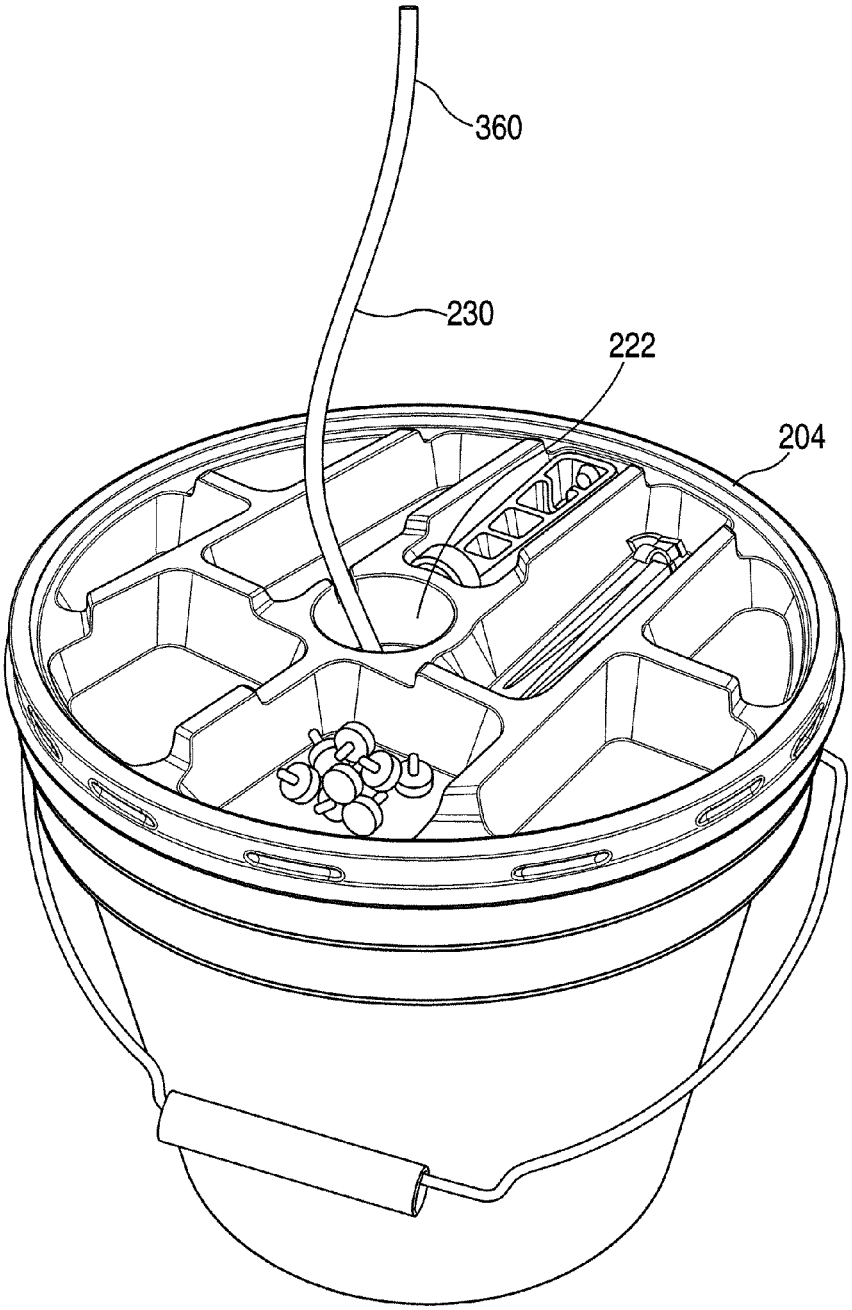
FIG. 21 is a perspective view similar to FIG. 20 showing a section of tubing having been withdrawn from the container through the dispensing aperture of the tray.

With reference to FIGS. 20-22, features of the tray 204 and lid 210 will be discussed in greater detail. The tray divider walls 254 may have raised portions 290 with upwardly facing support surfaces 292 thereon configured to support the inner portion 284 of the lid 210, as shown in FIGS. 20 and 23. These support surfaces 292 are particularly advantageous if the lid 210 is made of relatively thin material that may deflect with loading, such as by stacking of another dispenser 200 upon the lid 210. The tray 204 may therefore be of a relatively rigid material with a greater thickness while the lid 210 is made of a thinner, weaker material. This reduces the cost of the lid 210 because the lid 210 does not need to be strong enough to resist loading by itself. Further, the tray divider walls 254 are a form of reinforcing ribs that increase the strength of the tray 204 and make the tray strong enough to support the weight of other dispensers 200 stacked upon the lid 210, which may be three or more dispensers 200.

Figure 16:
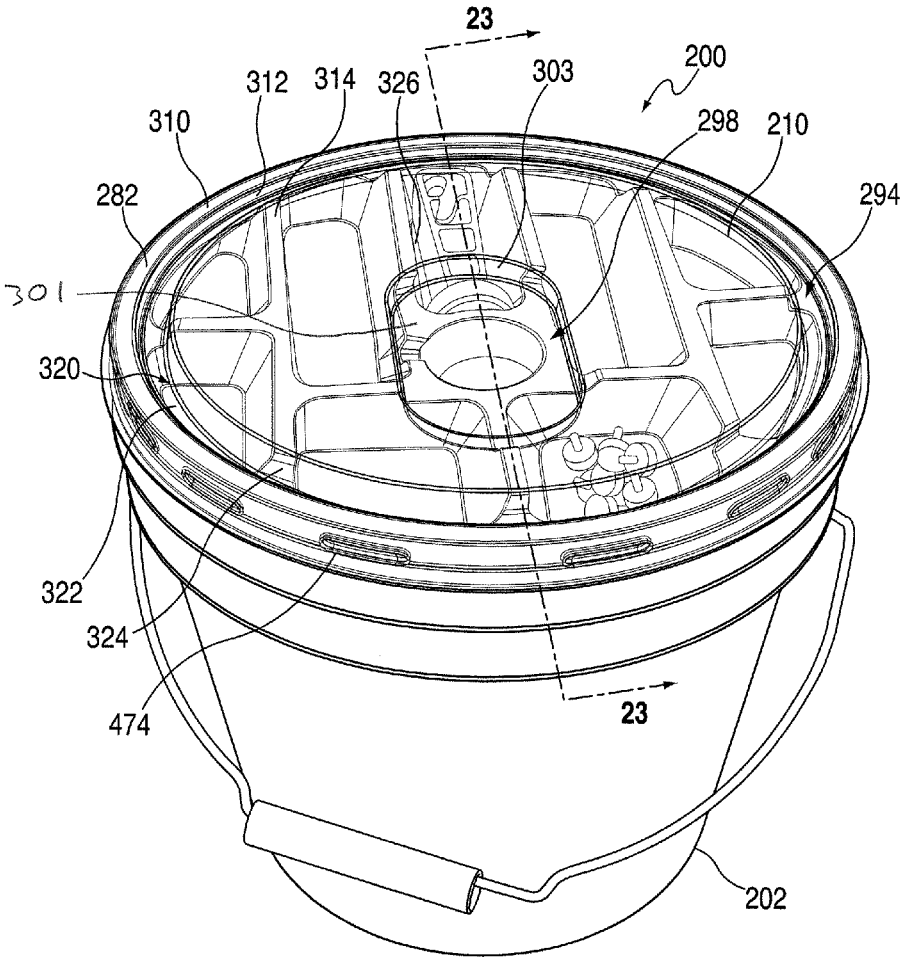
FIG. 16 is a perspective view of a dispenser for tubing and one or more components or tools for use with the tubing.

With reference to FIGS. 16 and 20, the tray 204 and the lid 210 have mating features that form an outer rigid channel 294 at the top of the dispenser 200 which is sized to receive an outer annular projection 296 (see FIG. 19) on an underside of a dispenser 200 stacked on top of the lid 210. The engagement of the projection 296 and the channel 294 restricts relative lateral movement of the stacked dispensers 200 and improves shipping, handling of the stacked dispensers 200, and displaying of the dispensers 200.

More specifically, the divider wall raised portions 290 of the tray 204 have outer ends 300 and the tray rim 280 has a side wall 302 spaced from the divider wall outer ends 300 by flat 304 as shown in FIG. 20. The flats 304 separate the rim side wall 302 from the divider wall outer ends 300 and produce gaps 306 between the side wall 302 and the outer ends 300. The divider wall outer ends 300, rim side wall 302, and flats 304 form the tray-side portion of the dispenser channel 294.

With reference to FIG. 16, the lid-side portion of the dispenser channel 294 will be discussed. Specifically, the lid outer portion 282 has an outer skirt 310 for releasably engaging the tray rim 280 in a manner similar to the mechanism for connecting the tray 204 to the container 200. The skirt 310 includes an inner side wall 312 that extends downward along the tray side wall 302, a base wall 322 extending above the tray flats 304, and an upstanding transition wall 324 that extends along the divider wall outer ends 300 (see FIGS. 16 and 20). When the lid 210 is connected to the tray 204, the tray divider wall outer ends 300, rim sidewall 302, and flats 304 support and resist deflection of the lid inner side wall 312, base wall 322, and transition wall 324. This provides a rigid structure for resisting vertical and lateral loads imposed by one or more dispensers 200 stacked on top of the lid 210.

The location of the dispenser channel 294 also increases the rigidity of the dispenser 200. The dispenser channel 294 is positioned near the rim 250 of the container 202 so that vertical loading applied by a dispenser 200 stacked on top of the lid 210 can be more directly transferred to the container 202, as shown in FIGS. 16 and 18. This reduces the distance of the suspended load from the container rim 250 which increases the strength of the tray 204 and lid 210 assembly.

Turning to FIGS. 16 and 20, the tray 204 and lid 210 have features that form an inner rigid alignment recess 298 having a generally obround shape that is configured to engage an inner annular projection 299 (see FIG. 19) on the underside of a dispenser 200 stacked on the lid 210. More specifically, the tray-side portion of the alignment recess 298 includes tray divider wall inner ends 340 spaced apart from one another by flats 342 which define a receiving area 344 around the tubing compartment 224, as shown in FIG. 20. The lid-side portion of the alignment recess 298 includes a recessed base wall 301 and an upstanding transition wall 303, as shown in FIG. 16. When the lid 210 is connected to the tray 204, the lid base wall 301 lies above the tray flats 342 and the lid transition wall 303 extends along the tray inner ends 340. The tray flats 342 and inner ends 340 thereby support and resist deflection of the lid base wall 301 and transition wall 303, portions of which are engaged with the inner annular projection 299 of the container 202 when one or more dispensers 200 are stacked on top of the lid 210. This provides another rigid structure for resisting vertical and lateral loads imposed by one or more dispensers stacked on top of the lid 210.

Another feature of the alignment recess 298 is that the lid base wall 301 and the lid receiving area 344 are both generally obround and disposed off-center of the dispenser 200. This configuration acts as an alignment feature for connecting the lid 210 to the tray 204. Specifically, the lid base wall 301 and the tray receiving area 344 need to be aligned and similarly oriented in order to permit the lid base wall 301 to seat fully within the tray receiving area 344. If the lid base wall 301 and tray receiving area 344 are not fully aligned (e.g, the lid 210 is rotated ninety degrees from the position shown in FIG. 16), the lid transition wall 303 may interfere with the tray inner ends 340 and inhibit full seating of the lid base wall 301 in the tray receiving area 344. This alignment functionality provided by the recess 298 may be useful in ensuring locking protrusions 454 and 474 of the tray 204 and lid 210 (see FIGS. 16, 17, and 23) are aligned when the lid 210 is connected to the tray 204, as discussed in greater detail below. Although the alignment recess 298 is illustrated as being obround, it will be appreciated that other shapes and orientations of the components of the alignment recess 298 and/or other structures can be used to orient the lid 210 relative to the tray 204.

The materials selected for the dispenser 200 are preferably strong enough to endure loading applied during shipping and use of the dispenser 200. Further, the materials selected for the container 202, tray 204, and lid 210 are preferably selected to be waterproof so that the dispenser 200 can be displayed in outdoor retail environments without water adversely affecting the dispenser 200. In one form, the tray 204 and lid 210 are made of PVC and the container 202 is HDPE.

With reference to FIGS. 18, 20 and 21, methods of assembling and using the dispenser 200 will be discussed. To assemble the dispenser, the container 202 is initially provided with or without tubing 232 disposed within the inner volume 270. If the container 202 is to be provided with tubing 232, the tubing 232 may be inserted into the container 202 by hand or in an automated fashion, for example. Next, the tray 204 is connected to the rim 250 of the container to close the opening 272 and retain the tubing 232 within the container 202 (if the tubing 232 is present).

The irrigation components 206 and tool 208 may then be inserted through the compartment openings 260 and into the compartments 220. Inserting the irrigation components 206 and tool 208 into the compartments 220 may include positioning different components 206 in different compartments 220. For example, as discussed above, elongated components 206A can be positioned in compartment 220A whereas shorter components 206B can be positioned in compartment 220B. In another approach, the tray 204 is provided with one or more irrigation components 206 and tool(s) 208 disposed within the tray 204 before the tray 204 is connected to the container 202. For example, the tray 204 can be pre-loaded with the components 206 and tool(s) 208, the lid 210 connected to the tray 204, and then the tray 204 and lid 210 assembly are connected to the container 202. It will be appreciated that this loading could be automated.

Next, the lid 210 is connected to the tray 204, such as by engaging the lid skirt 310 with the tray rim 280 (see FIGS. 16 and 17). Connecting the lid 210 to the tray 204 may involve positioning the inner portion 284 of the lid 210 over the compartments 220 of the tray 204 in a manner that closes one or more of the openings 260 thereof. This captures the irrigation components 206 and tool 208 within the compartments 220. An additional closure element, such a shrink wrap, may be applied to fix the lid 210 to the container 202 and increase the overall rigidity of the dispenser 200. The application of the lid 210 can be performed by hand or could be automated, for example.

To dispense the tubing 230, irrigation components 206, and/or tool 208, the lid 210 (and any additional closure thereon) is initially removed from the tray 204. Next, the desired component(s) 206 and/or tool(s) 208 can be withdrawn from the tray compartments 220.

To withdraw tubing 232 from the container 202, the tray 204 may be removed from the container rim 250, with or without removing the lid 210, to provide access to the tubing 232 if the tubing 232 is positioned entirely within the container 202 (i.e., no tubing 232 extends outward from the dispensing aperture 224 such as during a first use). Alternatively, if the tubing 232 is provided separate from the dispenser 200, the tray 204 is removed to permit the user to insert the tubing 232 into the container 202.

Figure 19:
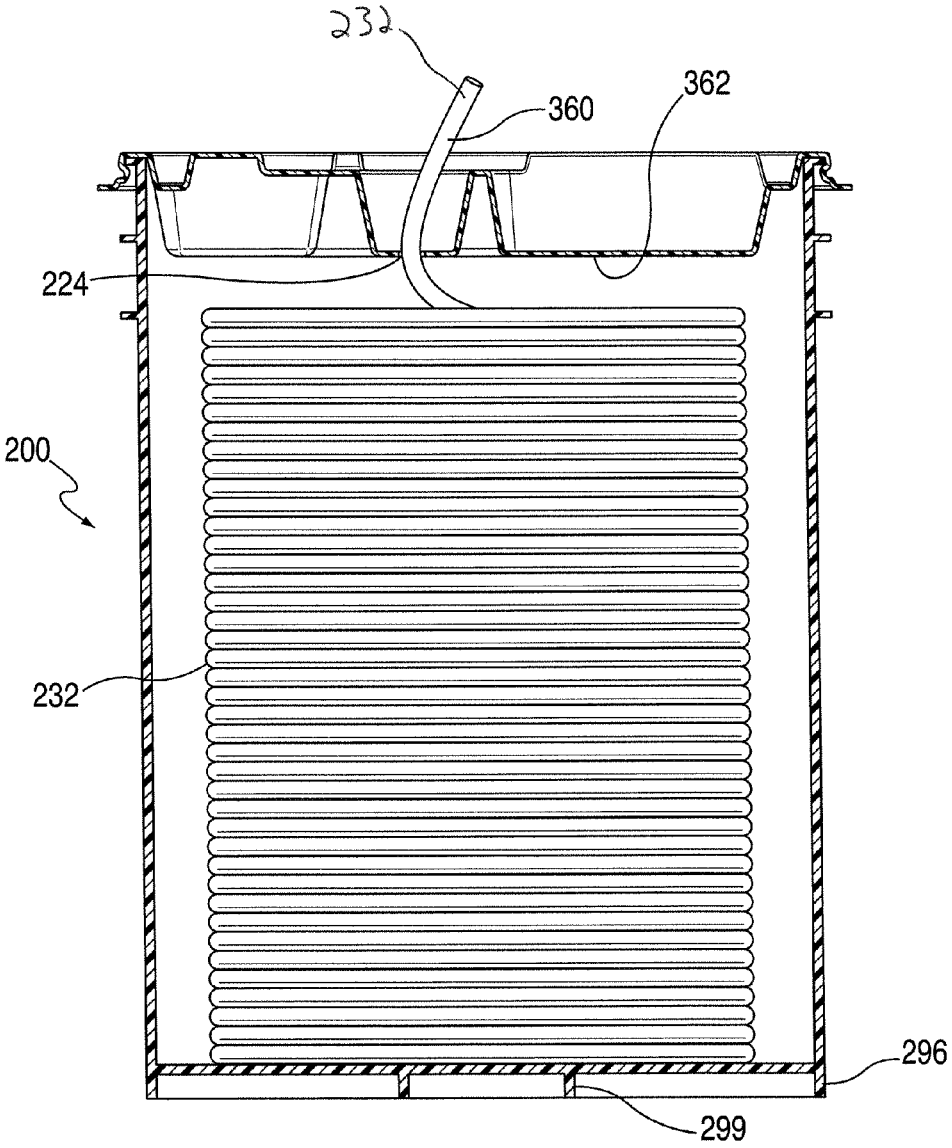
FIG. 19 is a cross-sectional view of the dispenser of FIG. 16 with the lid removed showing tubing extending through a dispensing aperture of the tray.
Figure 24:
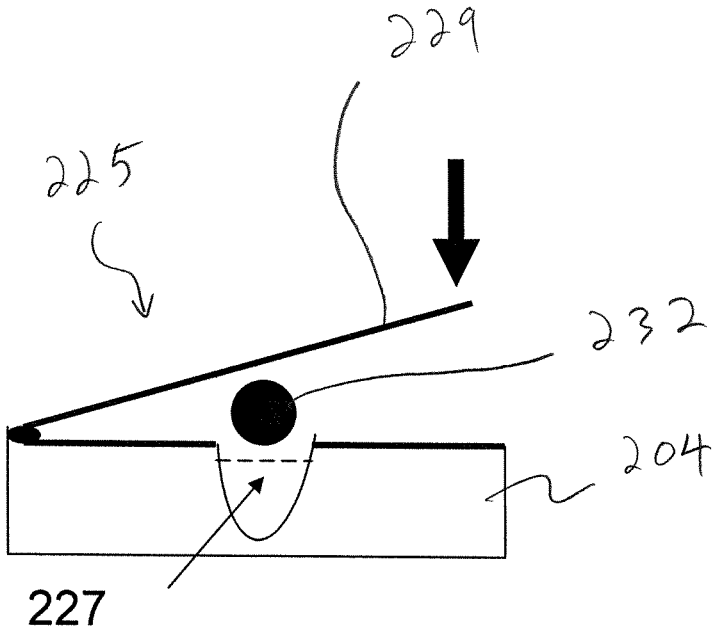
FIG. 24 is a schematic view of a cutting device that may be carried on the tray of FIG. 16.

Next, a leading end portion 360 of the tubing 232 is advanced from an underside 362 of the tray 204, through the dispensing aperture 224, and outward from the tubing compartment 222 (see FIG. 19). The tray 204 may then be reconnected to the container 202, the desired length of the tubing 232 may be dispensed, and a cutting device carried on the tray 204 may be used to cut the tubing 232 to a desired length. For example, a cutting device 225 having a blade 227 (see FIG. 24) may be mounted on the tray 204. The cutting device 225 may have a lever 229 that can be used to press the tubing 232 downward onto the blade 227 and cut the tubing 232. The cutting device 225 may be positioned near the dispensing aperture 224. The resulting free end 360 of the tubing 232 may then be positioned in the channel 262 to retain the tubing 232 in position before the lid 210 is re-connected to the tray 204.

It will be appreciated that the dispenser 200 may be carried to a work site and the lid 210 removed to provide access to the irrigation components 206, the tool 208, and/or the tubing 232 as may be desired. The dispenser 200 thereby provides a compact and easy-to-carry assembly of all the components and tools that a user may require for a particular task, such as repairing or expanding a drip irrigation system.

With reference to FIG. 22, additional details regarding the dispensing aperture 224 will be discussed. The tubing compartment 222 has a floor 400 with the dispensing aperture 224 formed therein. In one form, the dispensing aperture 224 includes an opening 402 through which the tubing 232 is advanced. The dispensing aperture 224 includes an edge 404 which engages an outer surface of the tubing 232 and forms a frictional engagement therewith to resist movement of the tubing 232 back into the container 202. The dispensing aperture 224 includes flaps 410 having edges and points 412 that engage the tubing 232 with a sharp-like contact to restrict movement of the tubing 232 back into the container 202. More specifically, the flaps 410 may pivot about connections 414 to the floor 400 in order to deflect out of the way of the tubing 232 as the tubing is withdrawn through the opening 402. However, the movement of the tubing 232 back into the container 202 tends to cause one or more of the flaps 410 to pivot toward each other about the connections 414 which engages the points 412 with the outer surface of the tubing 232. This further restricts the ability of the tubing 232 to travel back into the container 202 after the tubing 232 has been withdrawn through the opening 402.

With reference to FIG. 23, the connections between the container 202, tray 404, and lid 210 are shown in greater detail. The tray 204 has a locking portion 450 configured to releaseably engage the container rim 250. The tray locking portion 450 includes the tray skirt 242 and a locking protrusion 454 thereof that snaps under a lip 460 of the container 202. The tray skirt 242 may also have an outwardly extending flange 462 that may be grasped and used to pull a portion of the skirt 242 outwardly and disengage the locking protrusion 454 from the container lip 460. The lid 210 may have a similar locking portion 470 for releaseably engaging the locking portion 470 of the tray 204. The lid locking portion 470 includes the lid skirt 310 that engages the tray skirt 242 and a protrusion 474 of the skirt 310 that snap fits into a recess 476 of the tray protrusion 454. Like the tray flange 462, the lid 210 has an outwardly extending flange 478 that allows a user to grasp the flange 478 and pull outwardly on the lid skirt 310, which disengages the lid protrusion 474 from the tray recess 476. Thus, the tray locking portion 450 and lid locking portion 470 provide releasable snap-fit engagement of the tray 204 and lid 210 to the container 202 and to each other. In one form, the tray protrusions 454 and lid protrusions 474 are discontinuous around the periphery of the dispenser 200 which may increase the ease with which the tray 204 and lid 210 can be disconnected from the container 202 and each other.

While the invention has been particularly described with specific reference to particular method and product embodiments, it will be appreciated that various alterations, modifications, and adaptations may be based on the present disclosure, and are intended to be within the scope of the invention as defined by the following claims.

What is claimed is:

1. A dispenser for tubing and related components, the dispenser comprising:

a first container having a bottom wall and at least one side wall upstanding from the bottom wall, the at least one side wall having a first container inner surface portion facing inward about an opening of the first container and a first container outer surface portion facing outward;

tubing for being disposed within the first container;

a second container configured to be releasably connected to the first container to close the opening, the second container comprising:

a base for being releasably connected to the first container, the base defining a plurality of compartments and a base skirt portion, the base skirt portion having a base skirt portion inner surface for engaging the first container outer surface portion and a base skirt portion outer surface opposite the base skirt portion inner surface; and a lid for being releasably connected to the base, the lid covering the plurality of compartments of the base and including a lid skirt portion, the lid skirt portion having a lid skirt portion inner surface for engaging the base skirt portion outer surface;

a plurality of irrigation components for use with the tubing, the plurality of irrigation components being contained in the plurality of compartments of the base; and the second container having a first configuration wherein the base and lid are connected together and both the base and lid are disconnected from the first container and a second configuration wherein the base is connected to the first container and the lid is disconnected from the base.

2. The dispenser of claim 1 wherein the first container has a rim extending about the opening that includes the first container outer surface portion, the base skirt portion inner surface being configured to releasably engage the rim.

3. The dispenser of claim 2 wherein the lid skirt portion is configured to releasably engage the base skirt portion and provide overlapping nesting of the lid skirt portion, the base skirt portion, and the first container side wall.

4. The dispenser of claim 3 wherein the base skirt portion inner surface includes a snap-fit connection configured to releasably engage the first container rim and the lid skirt portion inner surface includes a snap-fit connection configured to releasably engage the base skirt portion outer surface.

5. The dispenser of claim 1 wherein the base includes a dispensing aperture configured to permit a section of the tubing to be advanced out of the first container while the base is connected to first container.

6. The dispenser of 1 wherein the plurality of irrigation components comprise different irrigation components in different compartments.

7. A dispenser for tubing and related components, the container comprising:

a first container having an upper opening and a lower annular projection, the first container having an inner surface facing inward and extending about the upper opening;

tubing for being disposed within the first container;

a second container including a base having an outer portion configured to be connected to the first container and an inner portion sized to be positioned at least partially in the opening of the first container, the second container further including a lid configured to be connected to the base;

one or more compartments of the inner portion of the second container base for receiving one or more components or tools for use with the tubing;

at least one opening of the one or more compartments that opens into the one or more compartments and permits access to the one or more components or tools and the lid covers the at least one opening with the lid connected to the base;

an annular channel portion of the lid of the second container sized to receive a lower annular projection of another dispenser stacked on the lid;

a side wall of the base inner portion extending along the inner surface of the first container with the base outer portion connected to the first container;

a flat portion of the base extending inward from the side wall;

wall portions of the inner portion of the base of the second container extending along the one or more compartments and having outer ends connected to the flat portion and separated from the side wall of the base by a gap sized to receive the annular channel portion of the lid therein; and the side wall, flat portion, and wall portion ends of the base mating with the annular channel portion of the lid to resist deflection of the lid annular channel portion due to loading from the lower annular projection received in the lid annular channel portion.

8. The dispenser of claim 7 wherein the lid includes a transparent portion covering the at least one opening of the one or more compartments so that the one or more components or tools are visible through the transparent portion.

9. The dispenser of claim 7 further comprising the tubing disposed in the first container and the one or more components or tools disposed in the one or more compartments of the second container.

10. A dispenser for tubing and related components, the container comprising:

a container having an opening and a rim extending about the opening;

tubing for being disposed within the container;

a tray having a tray locking portion configured to be connected to the rim of the container to close the opening, the tray having a tray flange portion disposed outward from the tray locking portion for gripping and separating the tray from the container, the tray having a plurality of compartments for receiving a plurality of irrigation components for use with the tubing;

an opening of one of the plurality of compartments of the tray that is sized to permit a section of tubing to be advanced out of the container through the opening;

a lid for covering the plurality of compartments and having a lid locking portion configured to engage the tray locking portion, the tray extending between the lid and the container so that the lid is completely spaced from the container with the lid locking portion engaging the tray locking portion;

the lid having a lid flange portion disposed outward from the lid locking portion that extends along and overlaps the tray flange portion with the lid connected to the tray for gripping and separating the lid from the tray;

the tray and lid having a first configuration wherein the tray and lid are connected to each other and both the tray and lid are disconnected from the container and a second configuration wherein the tray is connected to the container and the lid is disconnected from the tray.

11. The dispenser of claim 10 wherein the tray includes a device supported thereon that is configured to cut tubing dispensed from the tray opening.

12. The dispenser of claim 10 wherein the tubing is wound.

13. The dispenser of claim 10 wherein the tubing is precoiled and includes an outer wrap of flexible material configured to resist uncoiling of the tubing.

14. The dispenser of claim 10 wherein the tray opening includes an edge and the tubing and edge are configured to produce a friction engagement therebetween which controls movement of the tubing through the opening.

15. The dispenser of claim 10 wherein the container comprises:

a bottom wall; and at least one side wall upstanding from the bottom wall that includes the rim extending about the opening.

16. The dispenser of claim 1 wherein the first container has a rim that includes the first container outer surface portion; and the base skirt portion includes a channel that receives the first container rim, the channel including the base skirt portion inner surface that engages the first container outer surface portion with the base connected to the first container.

17. The dispenser of claim 16 wherein the lid skirt portion includes a channel that receives the channel of the base skirt portion, the channel of the lid skirt portion including the lid skirt portion inner surface that engages the base skirt portion outer surface with the lid connected to the base.

18. The dispenser of claim 10 wherein the lid flange portion extends outward farther than the tray flange portion.

* * * * *